United States Patent [19]

Monahan

[11] Patent Number: 4,836,002

[45] Date of Patent: Jun. 6, 1989

[54] PROGRAMMABLE LOCK APPARATUS AND METHOD

[76] Inventor: Brian J. Monahan, 28895 Cragmont Dr., Evergreen, Colo. 80439

[21] Appl. No.: 70,350

[22] Filed: Jul. 1, 1987

[51] Int. Cl.[4] ..... E05B 25/00

[52] U.S. Cl. ..... 70/382; 70/384; 70/385; 70/368; 70/340

[58] Field of Search ..... 70/340–343, 70/367–369, 377, 378, 382, 383–385

[56] References Cited

U.S. PATENT DOCUMENTS

| | | | |
|---|---|---|---|
| 1,216,752 | 2/1917 | Voight | 70/385 X |
| 1,561,223 | 11/1925 | Fremon | 70/382 |
| 2,427,814 | 9/1947 | Schachinger | 70/383 |
| 2,818,723 | 1/1958 | Levin | 70/383 |
| 3,348,392 | 10/1967 | Schreiber | 70/382 X |
| 3,431,757 | 3/1969 | Hori | 70/383 |
| 3,589,153 | 6/1971 | Hill | 70/378 X |
| 3,910,083 | 10/1975 | Burlingame | 70/383 |
| 4,116,026 | 9/1978 | Flint | 70/383 |
| 4,712,401 | 12/1987 | Monahan | 70/385 X |
| 4,747,281 | 5/1988 | Monahan | 70/385 X |

FOREIGN PATENT DOCUMENTS

| | | | |
|---|---|---|---|
| 2154652 | 9/1985 | United Kingdom | 70/358 |

*Primary Examiner*—Robert L. Wolfe
*Assistant Examiner*—Suzanne L. Dino
*Attorney, Agent, or Firm*—Chester E. Martine, Jr.

[57] ABSTRACT

A lock apparatus includes a lock provided with a cylindrical plug having a set of blind holes angularly spaced from the set of pinways in the plug. A longitudinal slot through the center of the blind holes accepts a programming member that lifts one or more master pins out of the blind holes and into housing pinways when the lock is unlocked with a master key and the plug is rotated into a rekeying position to align the blind holes with the housing pinways. The programming member has a hole or notch near its front end to facilitate removal when the lock is unlocked and the plug is in the rekeying position. The programming member may be in the form of a set blade or a set rod, and may be reversible end-to-end to provide additional rekeying combinations. A method includes programming the lock to operate with only one exclusively differently-bitted change key or sub-master key at a time by requiring a shallower bitting depth at a tumbler station from which a master pin has been removed and permitting and having a deeper bitting depth at a tumbler station to which a master pin has been inserted and thus rendered active.

45 Claims, 6 Drawing Sheets

17
17
90°
180°
270°

PROGRAMMABLE LOCK APPARATUS AND METHOD

BACKGROUND OF THE INVENTION

1. Field of the Invention

The present invention relates to the field of locks and more particularly to an apparatus for and method of rekeying a pin tumbler lock having tumbler pins, driver pins and at least two master pins without disassembly of the lock apparatus or removal or replacement of any master pins therefrom or therein.

2. Description of the Prior Art

Pin tumbler locks are widely used in providing security for commercial facilities. Such locks are sold in different embodiments, including mortise, rim, key-in-knob, and padlock cylinders.

A standard pin tumbler lock can be rekeyed by removing the plug that contains the tumbler pins and that is rotated to operate a latch or bolt. Such rekeying, of course, first requires removal of the lock from the door, for example, in which it is mounted. Then the lock is disassembled by removal of the plug and inserting different height tumbler pins in the plug, re-assembling the lock and re-installing the lock in the door.

The prior art includes hundreds of examples of ways in which locks can be rekeyed without removal of the lock from the door and without disassembling the lock. Numerous examples use the pin tumbler principle, such as shown in U.S. Pat. Nos. 2,325,358 to Hull and 2,427,837 to Connell. However, these have not used the standard pin tumbler lock construction which is of minimum size and is manufactured in relatively limited, standard varieties. As another example, U.S. Pat. No. 2,113,007 to Swanson shows complex sleeves and sleeve actuators between the plug and the housing of a pin tumbler lock, which requires major redesign of an existing pin tumbler lock. Other examples that do not use such a sleeve require enlarged, non-standard housings that are provided with additional pinways, driver pins and springs to provide a supply of master pins that can be interposed in the pin stacks of the enlarged pin tumbler lock for rekeying.

Others have attempted to rekey standard pin tumbler locks by making relatively minor modifications thereto. Such modifications only allow a limited number of different key combinations before the lock must be removed from the door and disassembled. See, for example, Smith U.S. Pat. No. 4,440,009, in which the rekeying is done by removing master pins from the lock. Another embodiment disclosed in the U.S. Pat. No. 4,440,009 inserts master pins into the lock, which requires dexterity and knowledge of the internal construction of the lock.

Despite these numerous attempts to enable pin tumbler locks to be rekeyed without removal from the door or disassembly of the plug from the housing, or without removing master pins from or adding them to the assembled and installed locks, to applicant's knowledge there has thus far been no pin tumbler lock made in commercial quantities that is rekeyable in a simple manner while assembled and installed in a door, and that can be manufactured by making a minimum of modifications to a standard pin tumbler lock and that provides extensive quantities of different key combinations.

Applicant's own prior efforts have provided some of these features, but have required a certain amount of skill on the part of the person doing the rekeying. Thus, even though such prior efforts have simplified and reduced the time required for a locksmith to rekey a pin tumbler lock without disassembly or removal from the door, a still simpler rekeyable lock based on the standard pin tumbler principle is required in order to make rekeyable pin tumbler locks available for everyday use. For example, maintenance personnel who are not trained as locksmiths but who must frequently and quickly rekey locks, find it desirable to be able to select from a substantial quantity of different key combinations. Also, landlords could reduce operating costs if an easy to rekey, pin tumbler lock were available as a replacement for the standard pin tumbler lock.

SUMMARY OF THE INVENTION

An object of the present invention is to simply modify a standard pin tumbler lock for rekeying, where the rekeying can be performed by unskilled personnel without removal of the lock from the door, for example, or disassembly of the lock cylinder, and yet provide a substantial quantity of exclusively different key combinations.

A further object of the present invention is to provided a modified standard pin tumbler lock in which a master key, that is normally available only to a manager of a commercial facility, must be used to rekey the lock. Once the lock has been unlocked using the master key, the positions of master pins relative to the existing plug and housing pinways of the standard pin tumbler lock are randomly selectable by the positioning or repositioning of a programming member in the plug, where the member may be in the form of a set blade or a set rod.

Another object of the present invention is to modify a standard pin tumbler lock to render such lock rekeyable, where the rekeying can be performed by unskilled personnel without removal of the lock from the door, for example, or disassembly of the lock, and yet provide a substantial quantity of exclusively different key combinations. The modification only involves machining blind master pin (magazine) holes into the existing plug at an axial location angularly spaced from that of the standard pinways, and machining a slot into the outer surface of the plug, end-to-end, so that the slot intersects each of the blind master pin magazine holes. With the standard lock modified, the lock is rekeyed by inserting one of a large quantity of unique programming members into such slot, which simply and easily renders the lock usable by only one unique change key in addition to the master key.

A still further object of the present invention is to provide a method of rekeying a standard pin tumbler lock that has been modified to provide blind holes in the existing plug, a slot extending axially in such plug and intersecting each blind hole and a supply of master pins in each such blind hole. Rekeying is accomplished by the steps of using a master key to unlock the lock by positioning any active master pins in the housing portions of the standard pinways and, rotating the plug to leave such active master pins in such portions and to align such blind holes with such portions. Then, a programming member is positioned in such slot to randomly and selectably control the position of the master pins relative to the shear interface, and thus relative to the plug and the housing, so that any master pins thereby positioned in such housing portions will become active master pins when the plug is rotated back to its locking position to rekey the lock.

With these and other objects in mind, a lock constructed according to the principles of the present invention may be based on a standard pin tumbler lock for use with first and second change keys, where the lock includes a housing and means such as a plug movable in the housing for operating a latch or bolt. The housing and the plug have first pinway means such as first holes for forming a plurality of first pinways intersectd by a shear interface. The first pinways have housing pinway portions extending in the housing. First pin means such as tumbler and driver pins are received in the plurality of first pinways for selective movement across the shear interface to prevent and permit movement of the plug in the housing. The lock is improved by providing second pin means in the form of master pins for selective movement across the shear interface. Also, second pinway means in the form of blind holes are formed in the plug corresponding to each of the housing pinway portions for receiving the master pins. A slot and a programming member intersect the blind holes for randomly and selectively moving at least one of the master pins across the shear interface into at least one randomly selectable one of the housing pinway portions to interpose the randomly selectable one of the master pins between the driver and tumbler pins received in the housing pinway portion. The interposed master pin becomes active. The random and selective master pin movement also results in the removal of a previously active master pin from the housing pinway portion. This requires use of the second change key to permit movement of the movable plug in the housing and prevents use of the first change key for such movement. The exclusive use of the second change key is achieved by requiring a shallower change key bitting depth at the tumbler station from which the active master pin was removed and allowing and having a deeper change key bitting depth at the tumbler station to which the new active master pin is added.

In accordance with the principles of the present invention, a method is provided for rendering a standard pin tumbler lock programmable for use with a plurality of exclusively different change keys. The rekeying contemplated is done without disassembling the lock each time the lock is rekeyed for a different one of the change keys. The standard pin tumbler lock is initially designed so that the initially intended rekeying can be performed only upon disassembly of the lock. The standard lock includes a housing, a bore extending axially through the housing to define a shear interface and a plug received in the bore. The housing and the plug have aligned holes therein forming at least first and second pinways that are axially placed along the plug and that are divided by the shear interface. The plug is rotatably received in the bore. The method of rendering such lock programmable includes the step of removing the plug from the bore. Plural blind holes are then formed in the outer surface of the plug and are axially aligned with the pinways. The depth of each blind hole is sufficient to receive at least one master pin. Next, a slot is formed extending from the front of the plug axially and intersecting each of the blind holes. At least one master pin is inserted into each of the blind holes and the plug is replaced in the bore. As a last step, a programming member is provided and is adapted to be received in the slot for selectively locating at least one of the master pins in an active position on the housing side of the shear interface in at least one of the holes in the housing.

In accordance with the principles of the present invention, a method of reprogramming the lock of the present invention includes the further steps of moving the plug relative to the housing into a locking position so that the first and second pinways are formed. Then all active master pins, if any, are moved into the housing holes, as, for example, by moving an active A station master pin into the A station housing hole. The plug is then moved from the locking position into a programming position in which the blind holes are in alignment with the housing holes, while retaining the master pins in the housing holes. At the programming position, at least one randomly selected master pin, for example the master pin at the B station, is moved into the B station housing hole and all other master pins are moved into the blind holes that are aligned with the other housing holes to render the other master pin inactive. The plug is then moved back to the locking position to position the one randomly selected master in in the B station housing hole so as to render the first change key ineffective and to render the second change key effective to cause movement of the plug in the housing to operate the latch.

BRIEF DESCRIPTION OF THE DRAWINGS

Other objects, features and advantages of the present invention will be apparent from an examination of the following detailed descriptions which include the attached drawings in which.

DETAILED DESCRIPTION OF THE PREFERRED EMBODIMENTS

Lock Apparatus 30

Figures 1, 2:
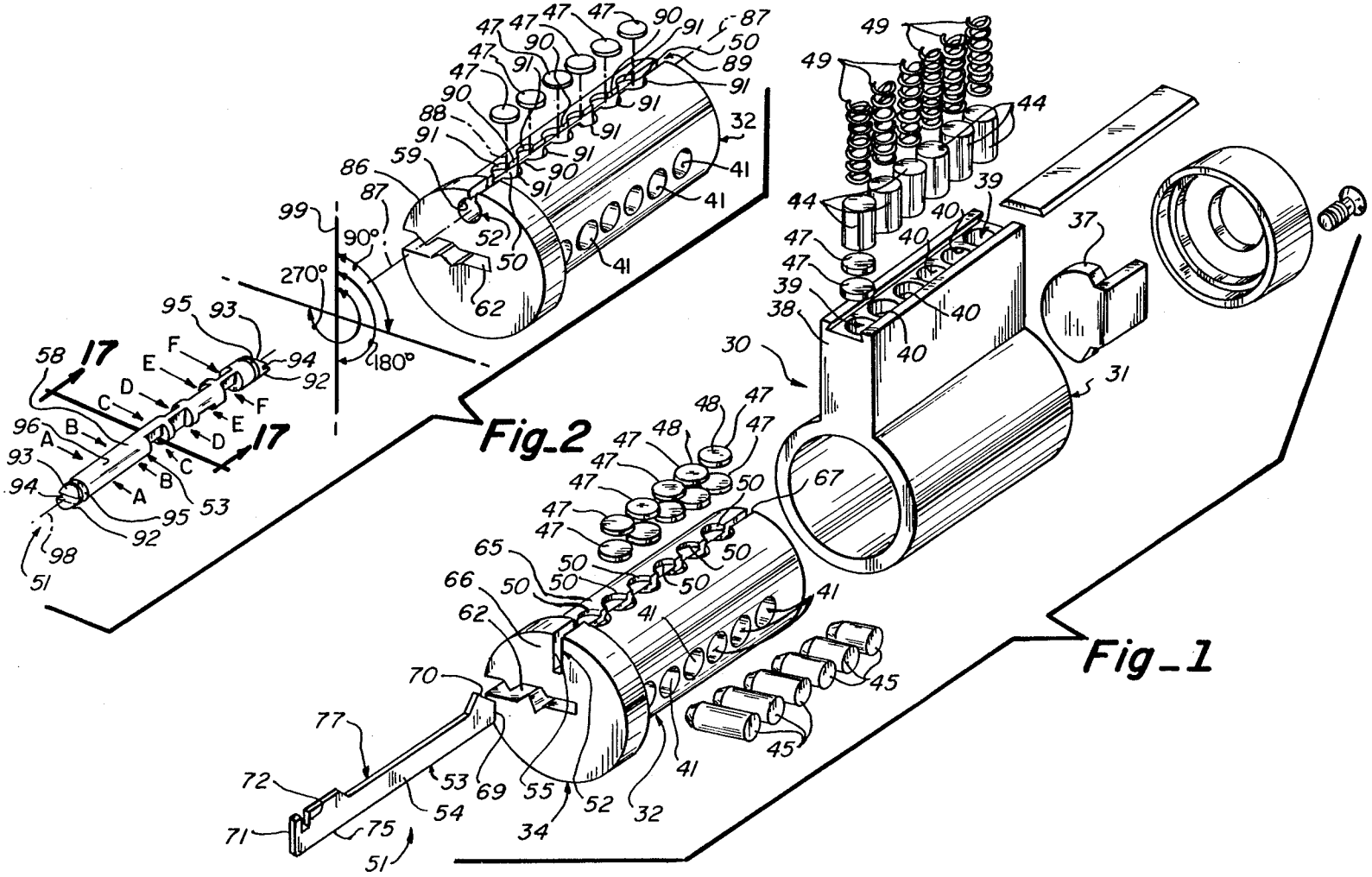
FIG. 1 is an exploded axonometric view of a standard key-in-knob pin tumbler lock modified according to the principles of the present invention to enable a plug to receive a programming member in the form of a removable set blade for randomly rekeying the modified lock.
FIG. 2 is an axonometric view of a standard pin tumbler plug modified according to the principles of the present invention to enable a plug to receive the programming member in the form of a removable rod for rekeying the modified lock.
Figure 9:
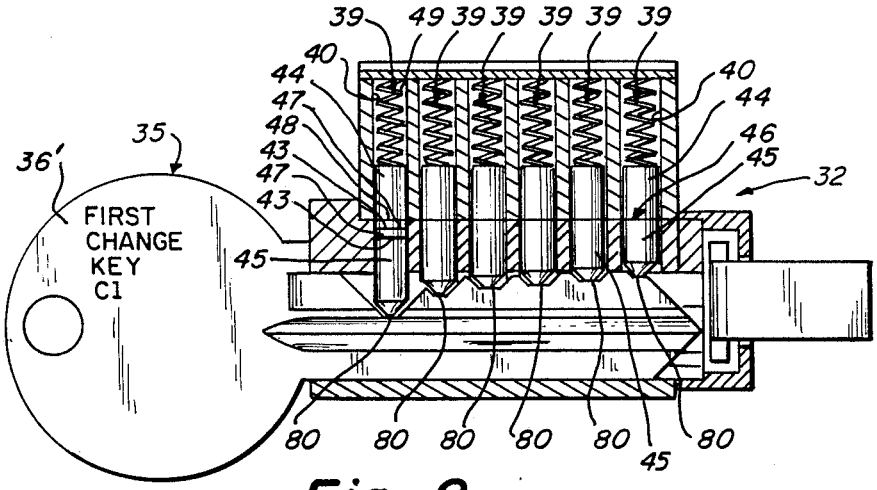
FIG. 9 is a vertical transverse cross section of the modified lock shown in FIG. 3 with the plug at the locking position and a first change key positioning two master pins below the shear interface to unlock the lock.

The first preferred embodiment of the lock apparatus of the present invention is illustrated in FIG. 1 as including a lock apparatus 30 that may be used to perform the method of the present invention to modify a standard pin tumbler lock 31 to render it programmable. When modified, the standard lock 31 is referred to as a modified lock 32. The modified lock 32 may be rekeyed without disassembling the lock. The lock 31 is referred to as a "standard" type lock since the unmodified structure is standard in the industry, and may be in the form of the key-in-knob lock shown in FIG. 1 or the standard pin tumbler padlock cylinder 33 shown in FIG. 21. A plug 34 of the standard lock 31 generally rotates at least 90° from a locked or locking position to an unlocked position. If the modified lock 32 is rekeyed for use of a particular change key (referred to generally by reference number 35), such as a first change key 36' (FIG. 9), the rekeying renders the lock 32 usable only with a second, randomly selectable change key 36" (FIG. 10) and not with the first change key 36' (FIG. 9).

Standard Pin Tumble Locks 31 and 33

The present invention is described in connection with standard pin tumbler locks, such as the key-in-knob pin tumbler lock 31 shown in FIG. 1 and the padlock type pin tumbler lock 33 shown in FIG. 21. An advantage of the present invention is that existing, installed standard locks 31, and other existing standard pin tumbler locks, can be modified by one method of the present invention to render them programmable. On the other hand, pin tumbler locks 32 can be originally made according to the principles of the present invention. The lock 32 shown in FIG. 1, made as a modified lock 32 or originally made according to the principles of the present invention, is referred to as a programmable lock cylinder, and the padlock 33 shown in FIG. 21, when made as a modified lock or originally made according to the principles of the present invention, is referred to as a programmable padlock cylinder.

In the following description, reference numbers that refer to an element and include a dash, e.g., "39—39", refer to the fact that many of the same such elements are provided.

Figure 11:
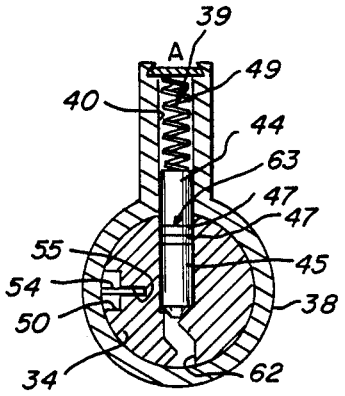
FIGS. 11 through 14 are a series of vertical radial cross sectional views illustrating the method of reprogramming the modified lock shown in FIG. 3 using a succession of different removable set blades.

The standard lock 31 shown in FIG. 1 includes a tailpiece 37 for operating a latch or bolt (not shown) operated upon rotation of the plug 34 in a housing 38. When the plug 34 is in an original or locked position (FIG. 11), a plurality of pinways 39—39 extend in the housing 38 and in the plug 34. The pinways 39—39 are formed by housing holes 40—40 in the housing 38 aligned with plug holes 41—41 in the plug 34. The pinways 39—39 are referred to as first pinways 39—39 to distinguish from second pinways 42—42 (FIGS. 6, 7, 13 and 14) that are formed when the plug 34 is in a programming or rekeying position shown in FIGS. 1, 13 and 14. The housing holes 40—40 are also referred to as housing portions of the pinways 39—39 and the first plug holes 41—41 are also referred to as plug portions of the pinways 39—39.

As shown in FIG. 9, the first change key 36' is used to unlock the lock 32 by aligning interfaces 43—43 between respective driver pins 44—44 and tumbler pins 45—45 with a shear interface 46. Where a master pin 47 is in one of the pinways 39—39, such as the A station pinway 39 (see station identification letters in FIG. 7, for example), a top surface 48 of the master pin 47 is aligned with the shear interface 46 to unlock the lock 31. Springs 49—49 are shown at the top of the housing portions 40—40 of the pinways 39—39 for urging the respective driver, master and tumbler pins 44, 47 and 45 downwardly.

Figure 10:
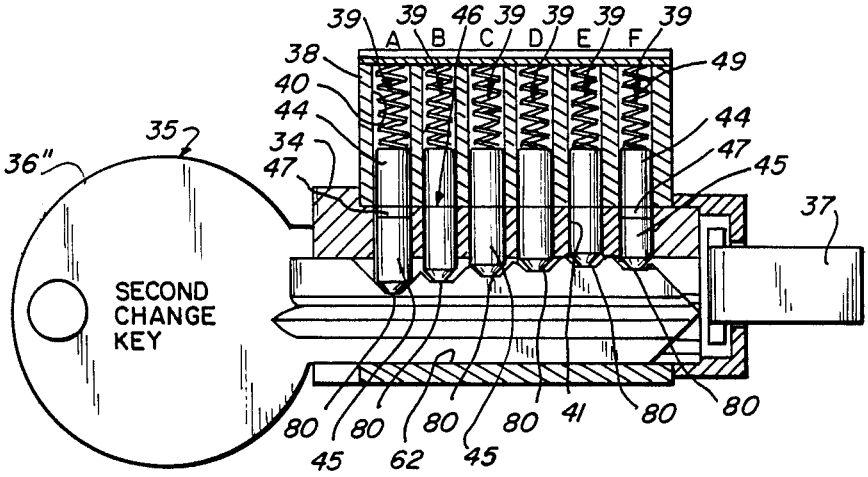
FIG. 10 is a vertical transverse cross section of the modified lock shown in FIG. 3 with the plug at the locking position and a second change key positioning one master pin in each of the A and F stations below the shear interface to unlock the lock.

Such a standard lock 31 is normally rekeyed by removing th plug 34 from the housing 38, rearranging the master pins 37—37 or the tumbler pins 45—45 and reassembling the lock 31. As rearranged, the tumbler pin 45-master pin 47 arrangement could be as shown in FIG. 10, such that a different or second change key 36" is required to unlock the lock 31. As there shown, the master pins 47—47 at the A and F stations are positioned below the shear interface 46 to unlock the lock 31.

Method of Modifying standard Lock 31

Figure 7:
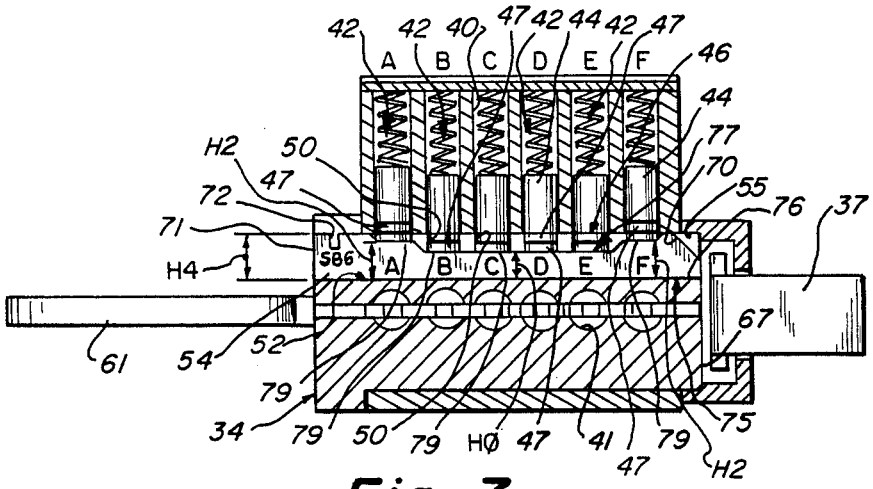
FIG. 7 is a vertical transverse cross sectional view similar to FIG. 6 showing a different removable set blade in the slot, this set blade having a contoured edge at the A and F stations for positioning one master pin in each of the housing portions of the A and F station pinways.
Figure 15:
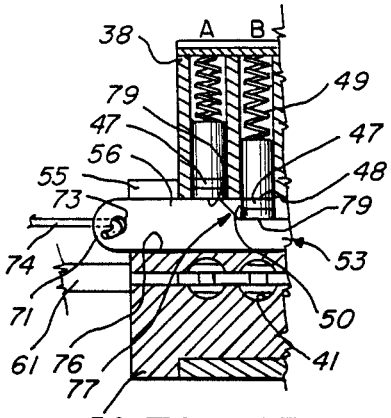
FIG. 15 is a partial vertical transverse cross sectional view of the plug of the modified lock showing another embodiment of the removable set blades in which an end thereof is shown extending out of the plug to expose a hole for use in removing the set blade from the slot.
Figure 16:
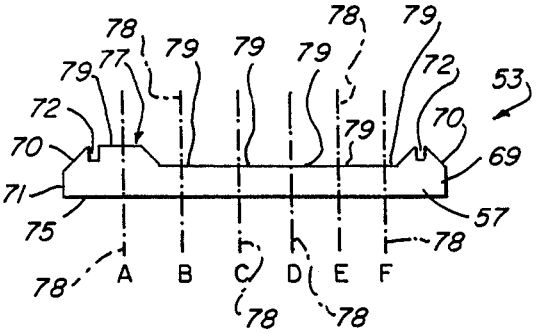
FIG. 16 is a side elevational view of a removable and reversible set blade that has an edge contour from the A station to the F station that differs from the edge contour from the F station to the A station so that a different key combination is provided upon end-to-end reversal of the set blade in the slot.

The standard lock 31 is shown in FIG. 1 modified according to the method of the present invention by removing the plug 34 from the housing 38 to provide the series of second pinways 42—42 (FIG. 7). The second pinways 42—42 are formed by blind holes 50—50 that are axially aligned with the first pinways 39—39, but that are angularly displaced around the outer circumference of the plug 34. Each blind hole 50—50 is adapted to receive one or more of the master pins 47—47. The method of modification also includes the provision in the plug 34 of a programming facility 51. Such facility 51 includes a slot generally referred to by reference number 52. The slot 52 has a rectangular cross section in a first embodiment shown in FIG. 1 and has a circular cross-section in a second embodiment shown in FIGS. 2, 18, 19 and 21. In each case, the slot 52 extends axially in the plug 34 and intersects each blind hole 50—50. With at least one master pin 47 in each blind hole 50—50, the plug 34 is then inserted in the housing 38 and the modified lock 32 is installed in a door or other thing (not shown) to be locked. To complete the method of rendering the standard lock rekeyable, the slot 52 then receives a programming member of the programming facility 51, generally referred to by reference number 53. A programming member 53 is shown as a first embodiment 54 in FIG. 1 for reception in the slot 52, which as shown is a first embodiment 55 of the slot 52. Programming members 53—53 are shown in FIGS. 15 and 16 as respective second and third embodiments 56 and 57 for reception in the slot 55. By exchanging different ones of the programming members 53—53 (FIG. 1), the modified lock 32 can be rekeyed for use with a maximum quantity of change keys 35.

In a similar manner, in a fourth embodiment 58 shown in FIG. 2, the programming member 53 can be exchanged. However, the programming member 58 can also be rotated when its is received in a second U-shaped embodiment 59 of the slot 52. The programming member 58 is used to rekey the modified lock 32 for the use of three different change keys 35 before being exchanged for another programming member 58. A programming member 60 shown in FIG. 21 as a fifth embodiment of the programming member 53 is not exchangeable, but can be rotated in the U-shaped slot 59 to rekey the modified lock 32 for the use of four different change keys 35.

Method of Programming the Modified Lock 32

Figure 5:
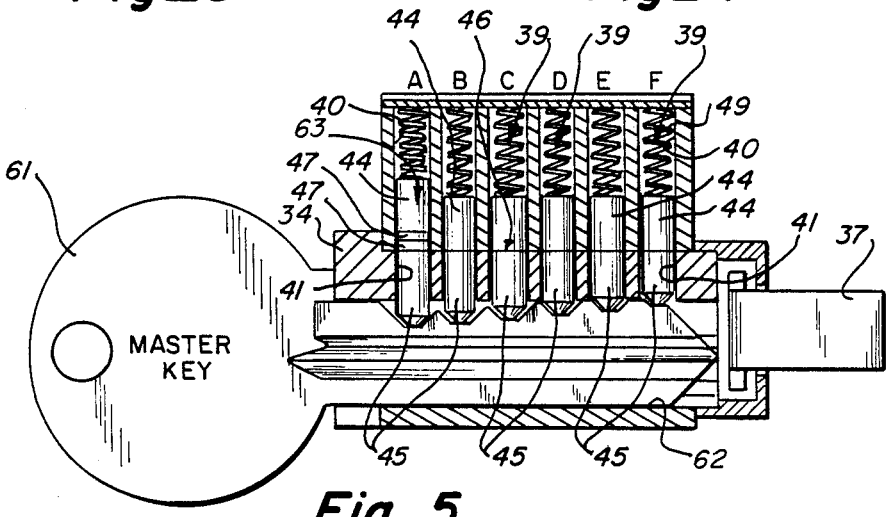
FIG. 5 is a vertical transverse cross sectional view taken along the section line 5—5 of FIG. 12 showing a master key for positioning active master pins above a shear interface to unlock the lock and to condition the lock for reprogramming.

The method of programming according to the principles of the present invention is illustrated first with the modified lock 32 (FIG. 1) having the first rectangular slot 55 and the programming member 54. A master key 61 is shown in FIG. 5 inserted in a keyway 62 with the plug 34 in the original or locking position (also see FIG. 12). The master pins 47—47 are shown in the A station pinway 39 for purposes of illustration and are referred to as "active" master pins 47—47 since they are part of a pin stack generally referred to by the reference number 63 that also includes the driver pin 44 and the tumbler pin 45. The active master pins 47—47 are moved by the master key 61 across the shear interface 46 and into the housing portion 40 of the A station pinway 39. This unlocks the modified lock 32. For comparison, FIG. 9 shows the first change key 36' (marked C1) that is effective to unlock the modified lock 32 by positioning both active master pins 47—47 below the shear interface 46 in the A station pinway 39.

Figure 13:
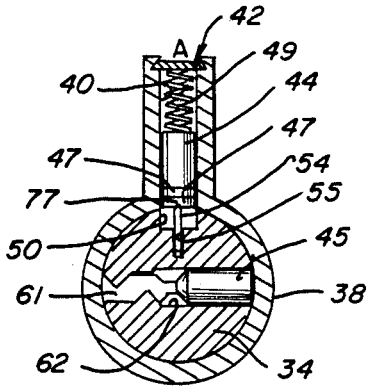

The master key 61 is used to rotate the plug 34 90° clockwise into the programming position shown in FIG. 13 at which the blind holes 50—50 are aligned with the housing portions 40—40 of the pinways 42—42. A programming member 54' (FIG. 6), which is marked SB1 (see FIG. 6) to indicate use with the C1 change key 36', is removed from the slot 55 and is exchanged for an SB6 programming member 54'' (see FIGS. 7 and 14) which is inserted into the slot 55. The SB6 programming member 54'' is selected as described later to randomly rekey the modified lock 32. Here, the SB6 programming member 54'' has been selected and renders the modified lock 32 usable with the C6 or second change key 36''. As shown in FIG. 7, the SB6 programming member 54'' positions only one active master pin 47 above the shear interface 46 in the A station pinway 42 and positions one active master pin 47 above the shear interface 46 in the F station housing portion 40 of the pinway 42. The master key 61 is then used to rotate the plug 34 90° counterclockwise back to the locking position. At that time, the A station pinway 39 shown in FIG. 11 will only have one active master pin 47, as shown in FIGS. 7 and 10. The rekeying method is complete without disassembling the modified lock or removing it from a door (not shown). Since none of the structure of the standard lock 31 is removed from the modified lock 32, the method of rekeying is said to be accomplished without removing any master pins from the modified lock 32, and in this sense the exchange of the SB1 and SB6 programming members 54' and 54'', respectively, is not considered removal or addition of any master pins.

When the programming members 58 and 60, of the respective fourth and fifth embodiments (FIGS. 2 and 21) are used in the rekeying method, and when the master key 61 has rotated the plug 34 to the rekeying position (FIGS. 18, 19 and 21), a flat ended tool, such as a screw driver (not shown), is used to rotate the programming members 58 and 60 90° or 180° or 270°, to transfer the master pins 47—47 from the blind holes 50—50 according to one of three or four other arrangements, such that the modified lock 32 is rekeyed for use with any one of two or three respective other change keys 36' or 36'' or 36'''.

Detailed Description - Modified Lock 32 With Programming Members 53

Figure 6:
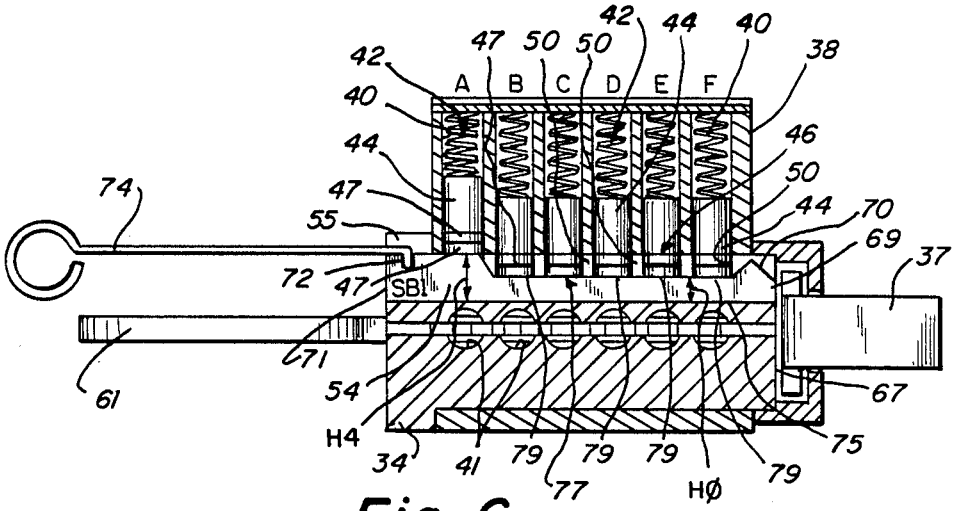
FIG. 6 is a vertical transverse cross sectional view taken along the section line 6—6 in FIG. 3 wherein the plug has been rotated 90° to align a series of blind holes with the housing portions of standard pinways, showing the removable set blade in a slot formed in the plug, the set blade having a contoured edge at the A station for positioning two master pins in the housing portion of the A station pinways.

Referring to FIGS. 1 and 6, the modified lock 32 of the present invention uses the housing 38, which is a standard, unmodified part of the standard lock 31. The plug 34 is shown in FIGS. 1, 7, 13 and 14 rotated 90° from the original position (shown in FIGS. 11 and 12) into the programming position, so that the blind holes 50—50 are aligned from a rotary standpoint with the housing portions 40—40 of the pinways 39—39. Each of the blind holes 50—50 has a diameter and a depth sufficient to receive one or more of the master pins 47—47, according to the maximum quantity of master pins 47—47 that have been selected for use in a given one of the pinways 39—39. FIG. 1 shows each blind hole 50—50 designed to receive two master pins 47—47 so that the upper or top surface 48 of the top master pin 47 is just below the shear interface 46 (see, for example, the B station shown in FIG. 15). In particular, the master pins 47—47 can each have a diameter of 0.115 inch and each is 2-depths, or 0.030 inch in thickness, and each blind hole 50—50 in FIGS. 1 and 11 through 14 is dimensioned to receive two of such master pins 47—47.

Depending upon the configuration of the programming member 53 that is used, the slot 52 can have different cross sections and lengths. As shown in FIGS. 1 and 11 through 14, the slot 55 has a rectangular cross section corresponding to that of the programming members 54, 56 and 57. The slot 55 does not intersect the keyway 62 nor the pinway portions 41—41 in the plug 34. As shown in FIG. 1, the slot 55 is machined into the outer surface 65 of the plug 34 in a longitudinal direction, from a front end 66 to a back end 67 of the plug 34. The slot 55 has a depth selected to receive the full working height H4 (see FIGS. 6 and 7) of the programming member 54.

The slot 55 is designed to receive the programming member 54 in the form of an elongated member referred to as a set blade (FIGS. 1, 6 and 7). The set blade 54 is one of a series of set blades referred to generally by the reference number 68 (FIGS. 6 and 7). Referring to FIGS. 1, 15 and 16, the structure common to all set blades 54, 56 and 57 in such series includes a leading end 69 that is inserted into the slot 55. A bevel 70 is provided on the leading end 69 so that as the set blade 54, 56 or 57 is inserted into the slot 55, the master pin 47 (or as shown in FIGS. 1 and 6 the two master pins 47—47), rides up on the bevel 70 and crosses the shear interface 46. The programming members 53 in the form of the set blades 54, 56 and 57 are inserted into the slot 55 until a trailing end 71 (FIGS. 1, 6 and 7) is flush with the front end 66 (FIG. 1) of the plug 34. At the trailing end 71 of the set blade 54 there is also a notch 72 (FIGS. 1, 6, 7, 8 and 16) or other means, such as a hole 73 shown in FIG. 15 for engaging the set blade 54 and exerting an axial force thereon for removing the set blade 54 from the slot 55. A hooked tool 74 shown in FIGS. 6 and 15 is inserted into the slot 55 to engage the notch 72 or the hole 73 and pull the set blade 54 out of the slot 55.

Figure 14:
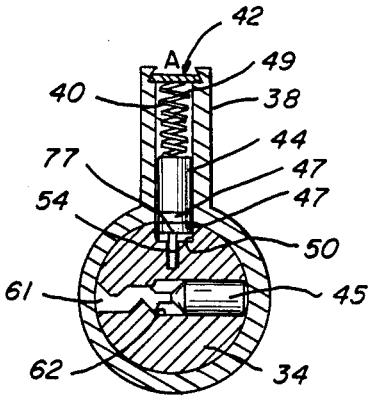

Referring for example FIGS. 6 and 7, each set blade 68, 56 or 67 of the series 58 of set blades has an edge 75 that rides on the bottom 76 of the slot 52, and an opposite edge or surface 77 (FIGS. 1, 7, 13, 14, 15 and 16) that is opposite to the housing pinway portions 40—40 when the set blade 54 is in the slot 55 and the plug 34 is in the rekeying position (FIGS. 13 and 14). The opposite edge 77 has a contour that is selected and defined for the purpose of rekeying the modified lock 32. To divide the contour of the opposite edge 77 into sections 79—79 vertical lines 78—78 are shown in FIG. 16. Each section 79—79 has a longitudinal length slightly longer than the diameter of a master pin except where less than such diameter because of adjacent lower contours (e.g. between stations A and B in FIG. 6). As shown in FIGS. 6, 7 and 16, the sections 79—79 are designated by the letters A through F to correspond to the A through F station designations of the modified lock 32. The contour of the edge 77 that is shown in FIG. 6 ranges from the A station having a height H4 that is the full depth of the slot 55, to the B through F stations that have a height H0 that is less by 0.060 inch, which is the thickness of two 2-depth master pins 47—47. The set blade 54 thus functions to support and position the A station master pins 47—47 above the shear interface 46, whereas the B through F master pins 47—47 are supported and positioned below the shear interface 46. The master pins 47—47 at station A that are on the side of the shear interface 46 toward the housing 38 are thus referred to as "active" master pins 47—47, since upon rotation of the plug 34 back to the original position (FIG. 12), the active master pins 47—47 are interposed between the driver pin 45 and the tumbler pin at the A station (FIGS. 11 and 12) in the pin stack 63.

The set blade 54'' (FIG. 7) is an example of one other set blade of the series 68 of set blades that is provided for rekeying the modified lock 32. Referring in detail to FIG. 7, the contour of the edge 77 of the set blade 54'' has the same H0 height at stations B through E for the same function, namely rendering the B through E stations, the sections 79 of the edge 77 provide the contour of the edge 77 with an H2 depth that is 0.030 inch, or one 2-depth master pin thickness. Thus, ten master pins 47—47 are inactive and two are rendered active.

Change Keys 35 and Series 68 of Set Blades

The modified lock 32 can be rekeyed for use with a set of twenty-one different change keys 35 when twelve 2-depth master pins 47—47 are used as shown in FIG. 1. The series 68 of set blades that render such modified lock 32 so rekeyable is defined in Chart 1 below. The data in the column headed "Active Master Pin Positions" defines how many, if any, master pins 47—47 are active in a given one of the A through F stations. The M line in Chart 1 defines the master key 61. For reference, the next line in Chart 1 corresponds to FIGS. 5, 6 and 9 where two stacked 2-depth master pins 47—47 in station A are active. The data in the column headed "Set Blade Sections" indicates the height of the section 79—79 of the edge 77 at a particular one of the A through F stations. There, "4" indicates the A station height H4 in FIG. 6, "O" represents the height H0 (see FIG. 6, stations B through F or FIG. 7 stations B through E). In the third line of Chart 1, the "2" set blade section 79 corresponds to heights H2 at stations A and F shown in FIG. 7, for example. Chart 1 also defines the heights of bittings 80—80 of the particular change key 35 for which the modified lock 32 is rekeyed when a particular set blade 53 is inserted in the slot 52. Thus, the 1 (or C1) first change key 36' has bittings 80—80 that have the following depths at respective A through F stations: 9,4,3,2,1,0. The "9" depth positions the two master pins 47—47 below the shear interface 46 (see FIG. 9), whereas the master key 61 (designated as M in chart 1) has an A station bitting that is 5, which is 4 less than that of the first change key 36', so that the two A station master pins 47—47 are positioned above the shear interface 46, and thus in the housing pinway portion 40 when the plug 34 is unlocked and conditioned for rekeying. Reference to the other data in Chart 1 will enable one skilled in the art to provide desired contours of the edges 77 on the other set blades 53 of the series 68 of set blades, and to cut the C2 through C21 change keys 35 for use with the modified lock 32 when a selected set blade 54 is inserted into the slot 55 of the modified lock 32.

It is to be understood that by exchanging one set blade 54 for another at random, there can be a random selection of the new (or second) change key 36'' for which the modified lock 32 is now rekeyed.

CHART 1

Data for Series 68 of Set Blades and Set of Change Keys 35 for Use with Modified Lock 32

| Active Master Pin Positions | | | | | | Set Blade Sections | | | | | | Change Key Bittings | | | | | | Blade/Key |
|---|---|---|---|---|---|---|---|---|---|---|---|---|---|---|---|---|---|---|
| A | B | C | D | E | F | A | B | C | D | E | F | A | B | C | D | E | F | Number |
| | | | | | | | | | | | | 5 | 4 | 3 | 2 | 1 | 0 | M |
| 2 | | | | | | | | | | | | | | | | | | |
| 2 | | | | | | 4 | 0 | 0 | 0 | 0 | 0 | 9 | 4 | 3 | 2 | 1 | 0 | 1 |
| 2 | 2 | | | | | 2 | 2 | 0 | 0 | 0 | 0 | 7 | 6 | 3 | 2 | 1 | 0 | 2 |
| 2 | | 2 | | | | 2 | 0 | 2 | 0 | 0 | 0 | 7 | 4 | 5 | 2 | 1 | 0 | 3 |
| 2 | | | 2 | | | 2 | 0 | 0 | 2 | 0 | 0 | 7 | 4 | 3 | 4 | 1 | 0 | 4 |
| 2 | | | | 2 | | 2 | 0 | 0 | 0 | 2 | 0 | 7 | 4 | 3 | 2 | 3 | 0 | 5 |
| 2 | | | | | 2 | 2 | 0 | 0 | 0 | 0 | 2 | 7 | 4 | 3 | 2 | 1 | 2 | 6 |
| | 2 | | | | | | | | | | | | | | | | | |
| | 2 | | | | | 0 | 4 | 0 | 0 | 0 | 0 | 5 | 8 | 3 | 2 | 1 | 0 | 7 |
| | 2 | 2 | | | | 0 | 2 | 2 | 0 | 0 | 0 | 5 | 6 | 5 | 2 | 1 | 0 | 8 |
| | 2 | | 2 | | | 0 | 2 | 0 | 2 | 0 | 0 | 5 | 6 | 3 | 4 | 1 | 0 | 9 |
| | 2 | | | 2 | | 0 | 2 | 0 | 0 | 2 | 0 | 5 | 6 | 3 | 2 | 3 | 0 | 10 |
| | 2 | | | | 2 | 0 | 2 | 0 | 0 | 0 | 2 | 5 | 6 | 3 | 2 | 1 | 2 | 11 |
| | | 2 | | | | | | | | | | | | | | | | |
| | | 2 | | | | 0 | 0 | 4 | 0 | 0 | 0 | 5 | 4 | 7 | 2 | 1 | 0 | 12 |
| | | 2 | 2 | | | 0 | 0 | 2 | 2 | 0 | 0 | 5 | 4 | 5 | 4 | 1 | 0 | 13 |
| | | 2 | | 2 | | 0 | 0 | 2 | 0 | 2 | 0 | 5 | 4 | 5 | 2 | 3 | 0 | 14 |
| | | 2 | | | 2 | 0 | 0 | 2 | 0 | 0 | 2 | 5 | 4 | 5 | 2 | 1 | 2 | 15 |
| | | | 2 | | | | | | | | | | | | | | | |
| | | | 2 | | | 0 | 0 | 0 | 4 | 0 | 0 | 5 | 4 | 3 | 6 | 1 | 0 | 16 |
| | | | 2 | 2 | | 0 | 0 | 0 | 2 | 2 | 0 | 5 | 4 | 3 | 4 | 3 | 0 | 17 |
| | | | 2 | | 2 | 0 | 0 | 0 | 2 | 0 | 2 | 5 | 4 | 3 | 4 | 1 | 2 | 18 |
| | | | | 2 | | | | | | | | | | | | | | |
| | | | | 2 | | 0 | 0 | 0 | 0 | 4 | 0 | 5 | 4 | 3 | 2 | 5 | 0 | 19 |
| | | | | 2 | 2 | 0 | 0 | 0 | 0 | 2 | 2 | 5 | 4 | 3 | 2 | 3 | 2 | 20 |
| | | | | | 2 | | | | | | | | | | | | | |
| | | | | | 2 | 0 | 0 | 0 | 0 | 0 | 4 | 5 | 4 | 3 | 2 | 1 | 4 | 21 |

Dual Set Blade Embodiment 81

Figure 4:
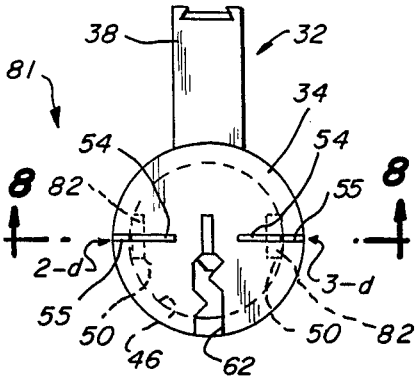
FIG. 4 is an elevational view of the front end of another embodiment of the modified lock in which two programming members are provided in the plug for providing a sub-master key capability to the randomly rekeyable lock.
Figure 22:
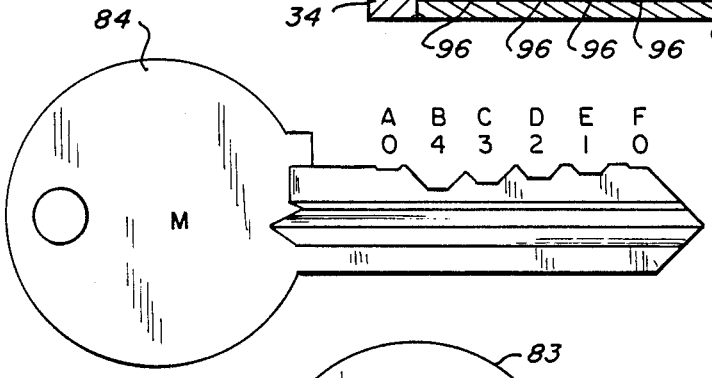
FIG. 22 is a master key for use with the submastered lock shown in FIG. 4.
Figure 23:
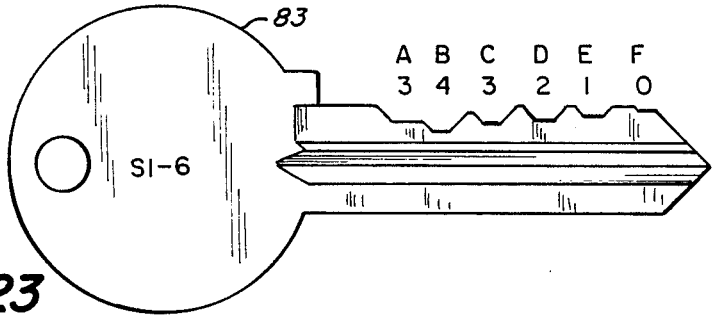
FIG. 23 is a sub-master key for use with the sub-mastered lock shown in FIG. 4.

FIG. 4 shows a front end elevational view of a dual set blade embodiment 81 of the modified lock 32 of the present invention in which two series 82 of blind holes 50—50 are formed in the plug 34 for having a greater variety of rekeying combinations, and for using the modified lock 32 with a sub-master keys 83—83 (FIG. 23). The modified lock 32 in this case is referred to as the dual modified lock 81. In submaster keying the dual modified lock 81 is usable with a second master key 84 (FIG. 22) and with six different sub-master keys 83—83, one of which (the S1-6 sub-master key) is shown in FIG. 23. The second master key 84 has bittings 0,4,3,2,1,0 and the submaster keys 83—83 have the following bittings:

CHART 2

Bittings for Sub-master Keys 83-83

| Sub-master Key Number | Sub-master Key Bittings A | B | C | D | E | F |
|---|---|---|---|---|---|---|
| S1-6 | 3 | 4 | 3 | 2 | 1 | 0 |
| S7-12 | 0 | 7 | 3 | 2 | 1 | 0 |
| S13-18 | 0 | 4 | 6 | 2 | 1 | 0 |
| S19-24 | 0 | 4 | 3 | 5 | 1 | 0 |
| S25-30 | 0 | 4 | 3 | 2 | 4 | 0 |
| S31-36 | 0 | 4 | 3 | 2 | 1 | 3 |

The S1-6 sub-master key 83 is usable with the dual modified lock 81 when it is rekeyed for use with the C1 through the C6 change keys 35. As an example, dual modified locks 81 that are set for the C1 through C6 change keys 35 may be on one floor of an apartment unit, such that maintenance personnel can be given access to the dual modified lock 81 on only that floor by issuing only the S1-6 sub-master key 83.

Figure 3:
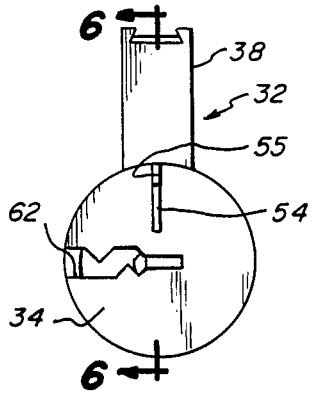
FIG. 3 is an elevational view of the front end of the modified lock shown in FIG. 1 illustrating the plug rotated 90° into a programming position.

The standard lock 31 can be modified to provide the series 82 of 2-depth blind holes 50—50, the slot 55 and the programming members 54 shown on the left in FIG. 4 as in the embodiment of the modified lock 32 shown in FIG. 3. A second of the series 82 of the blind holes 50—50, a slot 55 and a programming member 54 are formed and placed in the plug 34 opposite to the first series. The blind holes 50—50 of the second of the series 82 are described as 3-depth holes for receiving one master pin 47 that has a 0.045 inch, or 3-depth, thickness. The programming members 53—53 for use with both of the series 82 are set blades 54 having edges 77—77 provided with contours selected as described above with respect to FIGS. 6 and 7. In this case, only one master pin 47—47 is shown in each blind hole 50 or transferred across the shear interface 46. Also, the heights of the sections 79—79 of the edges 77—77 of the set blades 54 in the dual modified lock 81 are as shown in Chart 3 under the "Set Blade Sections" column, where the upper row of numbers is for the 2-depth set blade 54 and the lower row of members is for the 3-depth set blade 54. Chart 3 has the same other headings as Chart 1, and also has a "Sub-master Key Number" column to identify the sub-master keys 83 that are used with certain set blades 54 and change keys 35.

CHART 3

Data for Sub-Mastered Dual Modified Lock 81

| Active Master Pin Positions | | | | | | Set Blade Sections | | | | | | Change Key Bittings | | | | | | Set Blade/ Change Key | Sub-master Key |
|---|---|---|---|---|---|---|---|---|---|---|---|---|---|---|---|---|---|---|---|
| A | B | C | D | E | F | A | B | C | D | E | F | A | B | C | D | E | F | Number | Number |
| | | | | | | | | | | | | 0 | 4 | 3 | 2 | 1 | 0 | M | |
| 2 | | | | | | 2 | 0 | 0 | 0 | 0 | 0 | | | | | | | SB1/C1 | |
| 3 | | | | | | 3 | 0 | 0 | 0 | 0 | 0 | 5 | 4 | 3 | 2 | 1 | 0 | S1-6 | S1-6 |
| | | | | | | 0 | 2 | 0 | 0 | 0 | 0 | | | | | | | SB2/C2 | |
| 3 | 2 | | | | | 3 | 0 | 0 | 0 | 0 | 0 | 3 | 6 | 3 | 2 | 1 | 0 | S1-6 | S1-6 |
| | | | | | | 0 | 0 | 2 | 0 | 0 | 0 | | | | | | | SB3/C3 | |
| 3 | | 2 | | | | 3 | 0 | 0 | 0 | 0 | 0 | 3 | 4 | 5 | 2 | 1 | 0 | S1-6 | S1-6 |
| | | | | | | 0 | 0 | 0 | 2 | 0 | 0 | | | | | | | SB4/C4 | |
| 3 | | | 2 | | | 3 | 0 | 0 | 0 | 0 | 0 | 3 | 4 | 3 | 4 | 1 | 0 | S1-6 | S1-6 |
| | | | | | | 0 | 0 | 0 | 0 | 2 | 0 | | | | | | | SB5/C5 | |
| 3 | | | | 2 | | 3 | 0 | 0 | 0 | 0 | 0 | 3 | 4 | 3 | 2 | 3 | 0 | S1-6 | S1-6 |
| | | | | | | 0 | 0 | 0 | 0 | 0 | 2 | | | | | | | SB6/C6 | |
| 3 | | | | | 2 | 3 | 0 | 0 | 0 | 0 | 0 | 3 | 4 | 3 | 2 | 1 | 2 | S1-6 | S1-6 |
| | | | | | | 2 | 0 | 0 | 0 | 0 | 0 | | | | | | | SB1/C7 | |
| 2 | 3 | | | | | 0 | 3 | 0 | 0 | 0 | 0 | 2 | 7 | 3 | 2 | 1 | 0 | S7-12 | S7-12 |
| | 2 | | | | | 0 | 2 | 0 | 0 | 0 | 0 | | | | | | | SB2/C8 | |
| | 3 | | | | | 0 | 3 | 0 | 0 | 0 | 0 | 0 | 9 | 3 | 2 | 1 | 0 | S7-12 | S7-12 |
| | | | | | | 0 | 0 | 2 | 0 | 0 | 0 | | | | | | | SB3/C9 | |
| | 3 | 2 | | | | 0 | 3 | 0 | 0 | 0 | 0 | 0 | 7 | 5 | 2 | 1 | 0 | S7-12 | S7-12 |
| | | | | | | 0 | 0 | 0 | 2 | 0 | 0 | | | | | | | SB4/C10 | |
| | 3 | | 2 | | | 0 | 3 | 0 | 0 | 0 | 0 | 0 | 7 | 3 | 4 | 1 | 0 | S7-12 | S7-12 |
| | | | | | | 0 | 0 | 0 | 0 | 2 | 0 | | | | | | | SB/C11 | |
| | 3 | | | 2 | | 0 | 3 | 0 | 0 | 0 | 0 | 0 | 7 | 3 | 2 | 3 | 0 | S7-12 | S7-12 |
| | | | | | | 0 | 0 | 0 | 0 | 0 | 2 | | | | | | | SB6/C12 | |
| | 3 | | | | 2 | 0 | 3 | 0 | 0 | 0 | 0 | 0 | 7 | 3 | 2 | 1 | 2 | S7-12 | S7-12 |
| | | | | | | 2 | 0 | 0 | 0 | 0 | 0 | | | | | | | SB1/C13 | |
| 2 | | 3 | | | | 0 | 0 | 3 | 0 | 0 | 0 | 2 | 4 | 6 | 2 | 1 | 0 | S13-18 | S13-18 |
| | | | | | | 0 | 2 | 0 | 0 | 0 | 0 | | | | | | | SB2/C14 | |
| | 2 | 3 | | | | 0 | 0 | 3 | 0 | 0 | 0 | 0 | 6 | 6 | 2 | 1 | 0 | S13-18 | S13-18 |
| | | 2 | | | | 0 | 0 | 2 | 0 | 0 | 0 | | | | | | | SB3/C15 | |
| | | 3 | | | | 0 | 0 | 3 | 0 | 0 | 0 | 0 | 4 | 8 | 2 | 1 | 0 | S13-18 | S13-18 |
| | | | | | | 0 | 0 | 0 | 2 | 0 | 0 | | | | | | | SB4/C16 | |
| | | 3 | 2 | | | 0 | 0 | 3 | 0 | 0 | 0 | 0 | 4 | 6 | 4 | 1 | 0 | S13-18 | S13-18 |
| | | | | | | 0 | 0 | 0 | 0 | 2 | 0 | | | | | | | SB5/C17 | |
| | | 3 | | 2 | | 0 | 0 | 3 | 0 | 0 | 0 | 0 | 4 | 6 | 2 | 3 | 0 | S13-18 | S13-18 |
| | | | | | | 0 | 0 | 0 | 0 | 0 | 2 | | | | | | | SB6/C18 | |
| | | 3 | | | 2 | 0 | 0 | 3 | 0 | 0 | 0 | 0 | 4 | 6 | 2 | 1 | 2 | S13-18 | S13-18 |
| | | | | | | 2 | 0 | 0 | 0 | 0 | 0 | | | | | | | SB1/C19 | |
| 2 | | | 3 | | | 0 | 0 | 0 | 3 | 0 | 0 | 2 | 4 | 3 | 5 | 1 | 0 | S19-24 | S19-24 |
| | | | | | | 0 | 2 | 0 | 0 | 0 | 0 | | | | | | | SB2/C20 | |
| | 2 | | 3 | | | 0 | 0 | 0 | 3 | 0 | 0 | 0 | 6 | 3 | 5 | 1 | 0 | S19-24 | S19-24 |
| | | | | | | 0 | 0 | 2 | 0 | 0 | 0 | | | | | | | SB3/C21 | |
| | | 2 | 3 | | | 0 | 0 | 0 | 3 | 0 | 0 | 0 | 4 | 5 | 5 | 1 | 0 | S19-24 | S19-24 |
| | | | 2 | | | 0 | 0 | 0 | 2 | 0 | 0 | | | | | | | SB4/C22 | |
| | | | 3 | | | 0 | 0 | 0 | 3 | 0 | 0 | 0 | 4 | 3 | 7 | 1 | 0 | S19-24 | S19-24 |
| | | | | | | 0 | 0 | 0 | 0 | 2 | 0 | | | | | | | SB5/C23 | |
| | | | 3 | 2 | | 0 | 0 | 0 | 3 | 0 | 0 | 0 | 4 | 3 | 5 | 3 | 0 | S19-24 | S19-24 |
| | | | | | | 0 | 0 | 0 | 0 | 0 | 2 | | | | | | | SB6/C24 | |
| | | | 3 | | 2 | 0 | 0 | 0 | 3 | 0 | 0 | 0 | 4 | 3 | 5 | 1 | 2 | S19-24 | S19-24 |
| | | | | | | 2 | 0 | 0 | 0 | 0 | 0 | | | | | | | SB1/C25 | |
| 2 | | | | 3 | | 0 | 0 | 0 | 0 | 3 | 0 | 2 | 4 | 3 | 2 | 4 | 0 | S25-30 | S25-30 |
| | | | | | | 0 | 2 | 0 | 0 | 0 | 0 | | | | | | | SB2/C26 | |
| | 2 | | | 3 | | 0 | 0 | 0 | 0 | 3 | 0 | 0 | 6 | 3 | 2 | 4 | 0 | S25-30 | S25-30 |
| | | | | | | 0 | 0 | 2 | 0 | 0 | 0 | | | | | | | SB3/C27 | |
| | | 2 | | 3 | | 0 | 0 | 0 | 0 | 3 | 0 | 0 | 4 | 5 | 2 | 4 | 0 | S25-30 | S25-30 |
| | | | | | | 0 | 0 | 0 | 2 | 0 | 0 | | | | | | | SB4/C28 | |
| | | | 2 | 3 | | 0 | 0 | 0 | 0 | 3 | 0 | 0 | 4 | 3 | 4 | 4 | 0 | S25-30 | S25-30 |
| | | | | 2 | | 0 | 0 | 0 | 0 | 2 | 0 | | | | | | | SB5/C29 | |
| | | | | 3 | | 0 | 0 | 0 | 0 | 3 | 0 | 0 | 4 | 3 | 2 | 6 | 0 | S25-30 | S25-30 |
| | | | | | | 0 | 0 | 0 | 0 | 0 | 2 | | | | | | | SB6/C30 | |
| | | | | 3 | 2 | 0 | 0 | 0 | 0 | 3 | 0 | 0 | 4 | 3 | 2 | 4 | 2 | S25-30 | S25-30 |
| | | | | | | 2 | 0 | 0 | 0 | 0 | 0 | | | | | | | SB1/C31 | |
| 2 | | | | | 3 | 0 | 0 | 0 | 0 | 0 | 3 | 2 | 4 | 3 | 2 | 1 | 3 | S31-36 | S31-36 |
| | | | | | | 0 | 2 | 0 | 0 | 0 | 0 | | | | | | | SB2/C32 | |
| | 2 | | | | 3 | 0 | 0 | 0 | 0 | 0 | 3 | 0 | 6 | 3 | 2 | 1 | 3 | S31-36 | S31-36 |
| | | | | | | 0 | 0 | 2 | 0 | 0 | 0 | | | | | | | SB3/C33 | |
| | | 2 | | | 3 | 0 | 0 | 0 | 0 | 0 | 3 | 0 | 4 | 5 | 2 | 1 | 3 | S31-36 | S31-36 |
| | | | | | | 0 | 0 | 0 | 2 | 0 | 0 | | | | | | | SB4/C34 | |
| | | | 2 | | 3 | 0 | 0 | 0 | 0 | 0 | 3 | 0 | 4 | 3 | 4 | 1 | 3 | S31-36 | S31-36 |
| | | | | | | 0 | 0 | 0 | 0 | 2 | 0 | | | | | | | SB5/C35 | |
| | | | | 2 | 3 | 0 | 0 | 0 | 0 | 0 | 3 | 0 | 4 | 3 | 2 | 3 | 3 | S31-36 | S31-36 |
| | | | | | 2 | 0 | 0 | 0 | 0 | 0 | 2 | | | | | | | SB6/C36 | |
| | | | | | 3 | 0 | 0 | 0 | 0 | 0 | 3 | 0 | 4 | 3 | 2 | 1 | 5 | S31-36 | S31-36 |

Method of Programming For Sub-master Keys 83

Referring to the first line of Chart 3, and with the above description of the modified lock 32 in mind, it can be understood that the "2" and "3" in the "Active Master Pin Positions" column indicate respectively the station locations of the active 2-depth and 3-depth master pins 47—47. Each row in Chart 3 has two lines, the upper line defining which of six set blades 54 (SB1 through SB6) is for use in programming the 2-depth master pins 57—57. The lower line defines which of six set blades 54 (S1–6, S7–12, S13–18, S19–24, S25–30 and S31–36) is for use in programming 3-depth master pins 57—57. Thus as an example, for the C1 change key 35 and the S1–6 sub-master key 83, one 2-depth master pin 47 and one 3-depth master pin 47 should be received in the A station housing portion 40 of the pinways 39—39, and no master pins 47—47 are in the B through F station housing portions. The SB set blades 54 are identified as "SB" plus a number. They are used to program the modified lock 34 for the change keys 35 identified by "C" plus a number (e.g. C1) by controlling the 2-depth master pin 47. The set blades 54 identified as "S" plus a number (e.g. S1–6) are used to program for the sub-master keys 83—83 (e.g. S1–6) by controlling the 3-depth master pin 47. It should be understood that there are only six possible station positions for each of the 2-depth and 3-depth master pins 47—47, such that only six different 2-depth and six different 3-depth set blades 54 are required, for a total of twelve.

Figure 8:
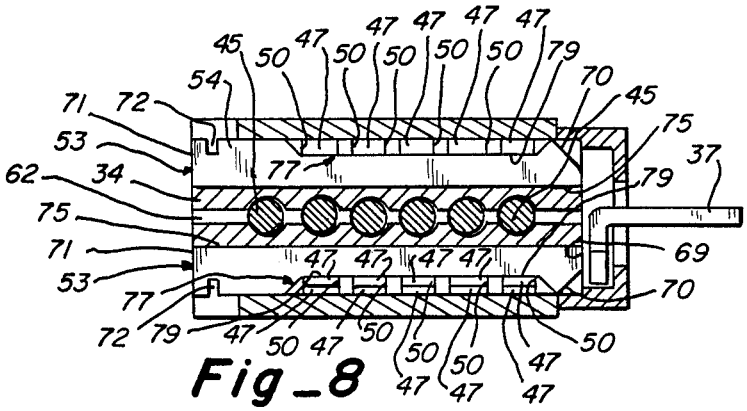
FIG. 8 is a horizontal transverse cross sectional view taken along the section line 8—8 of FIG. 4 showing the modified lock having two set blades, where one co-operates with 2-depth master pins and one co-operates with 3-depth master pins for reprogramming the modified lock for different change keys and sub-master keys.

Referring to FIG. 8, programming is accomplished by using the following steps in the following situations:

C1 to C6 Change Key 35

NOTE: This does not require exchanging the 3-depth S1–6 set blade 54.

1. Use the S1–6 sub-master key 83 to unlock the modified lock 32. This puts only the 2-depth active master pin 47 (A station) above the shear interface 46.
2. Rotate the plug 34 clockwise to align the 2-depth blind holes 50—50 with the housing portions 40—40 to form the second pinways 42—42.
3. Remove the SB1 set blade 54' and insert the SB6 set blade 54 into the slot 55. This renders the F station 2-depth master pin 47 active.
4. Rotate the plug 34 counter-clockwise to re-form the pinways 39—39 and to insert the 2-depth master pin 47 in the F station pin stack 63.
5. Remove the S1–6 sub-master key 83 from the keyway 62.

C1 to C7 Change Keys 35

NOTE: This does require changing the 3-depth S1--6 set blade 54.

1. Use the second master key 84 to unlock the modified lock 34. This positions both the active 2-depth and the active 3-depth master pins 47—47 above the shear interface 46 with the 3-depth master pin 47 lower than the 2-depth master pin 47.
2. Rotate the plug 34 counterclockwise to align the 3-depth blind holes 50—50 with the housing portions 40—40 to form the second pinways 42—42.
3. Remove the S1–6 set blade 54 from the slot 55 and insert the S7–12 set blade 54 in the slot 55. This renders the B station 3-depth master pin 47 active and the A station 3-depth master pin 47 inactive.
4. Rotate the plug 34 clockwise to re-form the pinways 39—39 and to insert the 3-depth master pin 47 in the B station pin stack 63.
5. Remove the second master key 84 from the keyway 62.

C1 to C8 Change Keys 35

NOTE: This requires exchanging both the 3-depth and the 2-depth set blades 34.

1. Use the second master key 84 to unlock the modified lock 32. This puts both active master pins 47 (A station) above the shear interface 46.
2. Rotate the plug 34 counterclockwise to align the 3-depth blind holes 50—50 with the housing portions 40—40 to form the second pinways 42—42.
3. Remove the SB*1–6* set blade 54 and insert the SB7–12 set blade 54 into the slot 55. This renders the B station 3-depth master pin 47 active.
4. Rotate the plug 34 clockwise to re-form the pinways 39—39 and to insert the 3-depth master pin 47 in the B station pin stack 63.
5. Remove the second master key 84 from the keyway 62.
6. Use the S7–12 sub-master key 83 to unlock the modified lock 32. This puts only the 2-depth active master pin 47 (A station) above the shear interface 46.
7. Rotate the plug 34 clockwise to align the 2-depth blind holes 50—50 with the housing portions 40—40 to form the second pinways 42—42.
8. Remove the SB1 set blade 54' and insert the SB2 set blade 54 into the slot 55. This renders the B station 2-depth master pin 47 active.
9. Rotate the plug 34 counter-clockwise to re-form the pinways 39—39 and to insert the 2-depth master pin 47 in the B station pin stack 63.
10. Remove the S7–12 sub-master key 83 from the keyway 62.

By using a selected one of the methods listed above according to the teachings of Chart 3, the dual modified lock 81 described can be rekeyed for use with any one of thirty-six different change keys 35 and with any one of six sub-master keys 83—83.

Set Blade 56 Having External Removal Hole 73

Referring to FIG. 15, the second set blade embodiment is shown as the set blade 56 inserted into the plug 34 with the trailing end 71 extending in front of the face of the plug 34. The trailing end 71 is provided with the hole 73 that is large enough in diameter to easily receive the hooked tool 74 or an opened paper clip (not shown) for removing the set blade 56 from the modified lock 32. Having the set blade 56 extend in front of the plug 34 does not raise a security risk since when the lock is unlocked using a change key 35 the removal of the set blade 56 traps the change key 35 until the same set blade 56 is re-inserted. With no set blade 56 in the slot 55, the master key 61 is the only key that is usable to unlock the modified lock 32.

Reversible Set Blade 57

Referring to FIG. 16, to reduce the number of different set blades that are required for programming the modified lock 32 for use with a given quantity of different change keys 35, the reversible set blade 57 is shown as the third embodiment of the programming member 53. The reversible set blade 57 is the same as the set blade 54, with three exceptions. Both ends 69 and 71 are provided with the bevels 70—70 and notches 72—72, so that either end of the reversible set blade 57 can be inserted into the slot 55. Also, the contour of the edge 77 of the reversible set blade 57 is dissimilar from the A through F stations as compared to that from the F through A stations. Referring to Chart 1, it can be observed that, for example, the SB2 and SB20 set blades 54 could be combined into one reversible set blade 57 since the A and B stations of the SB2 set blade 54 are each "2", and the E and F stations of the SB20 set blade 54 are each "2". The same applies to the SB3 and SB18 set blades 54, the SB1 set blade 54' and SB21 set blade 54 and the SB9 and SB14 set blades 54, etc.

Modified Lock 32

As described above, preferred embodiments of the present invention include the programming members 58 and 60 as fourth and fifth embodiments of the programming member 53 for use with the second embodiment of the slot 52 in the form of the U-shaped slot 59. The programming members 58 and 60 and the slot 59 may be provided in a second embodiment 85 of the modified lock shown in FIGS. 2, 17A–D, 20 and 21.

Referring to FIG. 2, the modified lock 85 is shown having the plug portions 41–41 of the pinways 39–39 of the standard pin tumbler lock 31. Also, the modification of the present invention is provided in the form of a series of blind holes 50'—-50' that extend longitudinally and that are angularly spaced from the row of plug portions 41—41 of the pinways 39—39. The blind holes 50'—-50' in FIG. 2 are machined having the same considerations in mind as described above with respect to the blind holes 50'—-50' shown in FIG. 1. However, as shown in FIG. 2, each of the blind holes is dimensioned to receive only one of the 2-depth master pins 47—47.

The programming facility 51 of the modified lock 85 includes the slot 59 having a U-shaped cross section (FIGS. 17A through D). The slot 59 is machined from behind a flange 86 of the plug to the back end 67 (see FIG. 1) of the plug along a longitudinally extending center line 87 that intersects the radially extending center lines 88 of the blind holes 50—50. As shown in FIG. 2, the slot 59 and the blind holes 50—50 combine to form a longitudinally extending groove 89 having alternating, longitudinally extending parallel walls 90—90 and opposed arcuate walls 91—91.

Figure 17A:
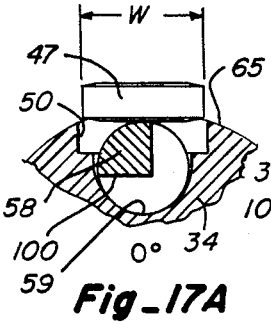
FIGS. 17A, 17B, 17C and 17D are partial cross-sectional views taken along line 17—17 in FIG. 2 showing four different rotary positions of the removable programming rod shown in FIG. 2 for controlling the position relative to the shear interface of a master pin.
Figure 17B:
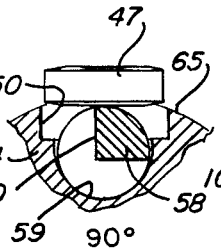
Figure 17C:
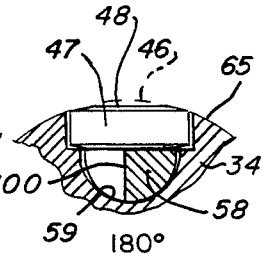

FIGS. 17A through 17D show the blind hole 50 at the C station and the U-shaped slot 59 in elevation. The blind holes 50'—-50' have a larger diameter W than the width of the U-shaped slot 59 (FIG. 17A). For example, the slot width can be up to 75% of the diameter W of the blind holes 50'—-50' and still provide enough width of the opposed arcuate walls 91—91 to retain a master pin 47 against longitudinal movement in the groove 89. The opposed arcuate walls 91—91 of the blind holes 50—50 thus retain a master pin 47 longitudinally aligned with the housing portion 40 of the opposite pinway 42 during the rekeying operation.

FIGS. 17A through 17D also show the 2-depth of the blind holes 50'—50' below the outer surface 65 of the plug 34 for fully receiving the master pins 47—47. As a result, the top surface 48 of the inactive master pin 47 (FIG. 17C) received in the blind hole 50' is aligned with the shear interface 46 to permit the plug 34 to rotate. The U-shaped slot 59 is machined to a greater depth for receiving the full diameter of the programming member 58, which is in the form of an elongated rod that is referred to as a set rod.

Set Rod 58

As shown in FIG. 2, the set rod 58 is an elongated member. Each end 92—92 of the set rod 58 is provided with a bevel 93 that functions the same as the bevels 70—70 of the set blades 57—57. Similarly, each end 92—92 has a radially extending, cut 94 therein for receiving a tool, such as a screw driver, not shown, for rotating the set rod 58 into a selected angular position in the slot 59. To assist in removal and exchanging the set rods 58—58, each end 92—92 of each set rod 58 is also provided with an annular groove 95 to facilitate reception of a hooked tool 71 as shown in FIG. 6 in the manner in which the notch 72 of the set blade 56 is used.

Figure 18:
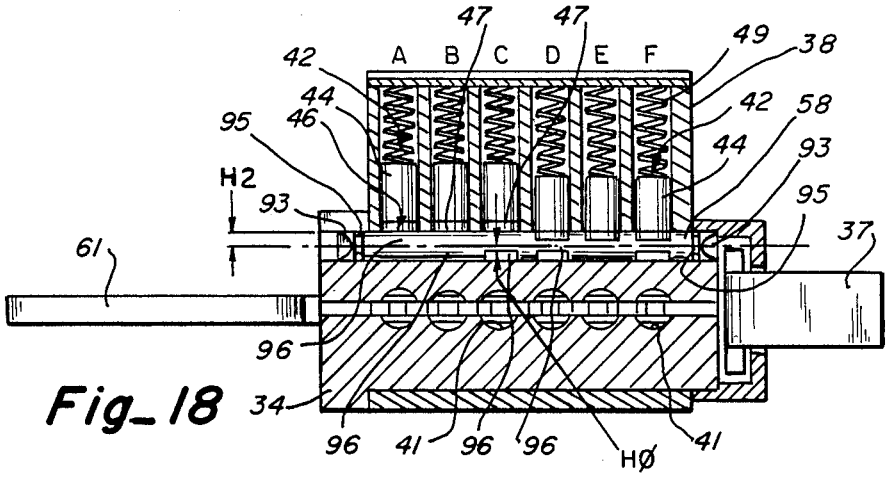
FIG. 18 is a transverse cross sectional view of the lock shown in FIG. 2 with the plug rotated into the programming position and the removable set rod in a first rotary position.
Figure 19:
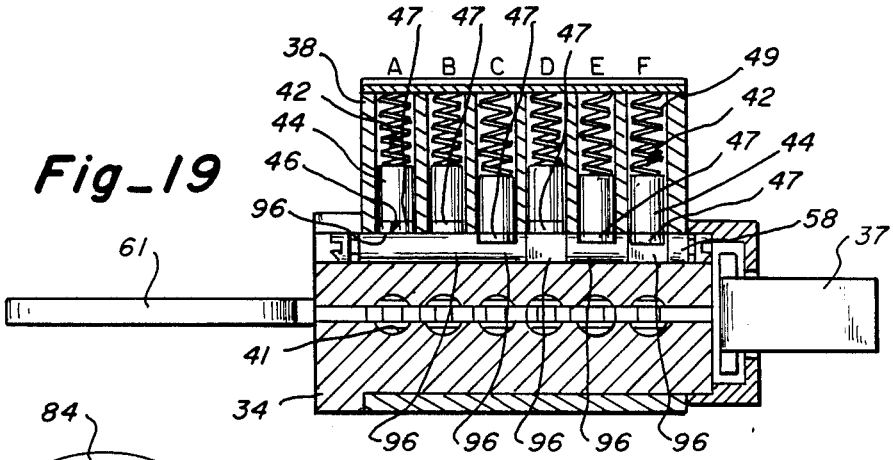
FIG. 19 is a view similar to FIG. 18, in which the set rod has been rotated 90° into a second rotary position.

An axial or longitudinally extending section 96 of the set rod 58 is received in each blind hole 50. As shown in FIGS. 18 and 19, there are six axial sections 96. One section 96 is in each of the six blind holes 50—50. The axial sections 96 are referred to in terms of the station at which they are located. Thus, the C station section 96 shown in FIGS. 17A through 17D is between the arcuate walls 91 of the blind hole 50 at the C station, which is opposite to the C station housing portion 40 of the pinways 42—42.

Referring to FIG. 2, the set rod 58 is shown having a longitudinally extending outer surface 97 that has four different and selectable longitudinal contours. The four different longitudinal contours are located at angularly spaced positions around a central axis 98 of the set rod 58. The angular positions are referenced from a vertical axis 99 through which the set rod 58 is rotated and are at 0°, 90°, 180°, and 360° from such vertical axis 99. For convenience and as described below, the longitudinal contours of the set rod 58 are set forth in Chart 4, where the angular position is noted in terms of degrees from the vertical axis 99 and the longitudinal sections 96 are designated with the A through F station letters.

CHART 4

| Angular Position (Degrees) | Description of Set Rod 58 — Station A | B | C | D | E | F |
|---|---|---|---|---|---|---|
| 0° | 2 | 2 | 2 | 2 | 2 | 2 |
| 90° | 2 | 2 | 2 | 0 | 0 | 0 |
| 180° | 2 | 2 | 0 | 2 | 0 | 0 |
| 270° | 2 | 2 | 0 | 0 | 2 | 0 |

The set rod 58 is designed to be reversible, in the manner of the reversible set blade 57. To permit removal of the set rod 48 and the exchange of it for another set rod 58 or reversal and re-insertion of the same set rod into the slot 59, at 0° the A through F station sections 96 of the set rod 58 have a full (shown as "2" in Chart 4) height H2 (see FIGS. 18 and 19) equal to the full radius of the set rod 58. As may be understood from FIG. 18, the full (or "2") height H2 at section A lifts the A station master pin 47 into the housing portion 40 at the A station. As shown in FIG. 2, with all of the A through F sections 96 having a full height H2 at the 0° position, the set rod 58 is easily removable and re-insertable since no master pin 47 will fall below the shear interface 46 as the set rod 58 is moved longitudinally.

The 90° position of the set rod 58 shown in FIG. 2 is identified by horizontal arrows that point to the right and are marked A, B, C, D, E and F to indicate the A through F sections 96. As shown in FIGS. 2 and 18, the "O" height H0 at the D, E and F sections allows the master pins 47—47 at those stations to be in the blind holes 50—50 at those stations, so that they will be inactive. In a similar manner, when the set rod 58 has been rotated to the 180° position the A, B and D station master pins 47—47 will be active and the C, E and F station master pins 47—47 will be rendered inactive. At the 270° position identified by horizontal arrows that point to the left and that are also marked A, B, C, D, E and F to correspond to the A through F sections, the set rod 58 will render only the A, B and E master pins 47—47 active.

Figure 17D:
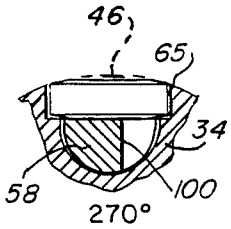

As a specific example of the C station sections 96 of the set rod 58, reference is made to FIGS. 17A through 17D. The set rod 58 is shown cut away at section C leaving one quarter portion of the set rod 58. The quarter portion has the full "2" height H2 in the 0° and 90° positions, such that the master pin 47 at the C station is above the shear interface 46, is in the C station housing portion 40 of the pinway 42, and is thus active. Rotation of the set rod 58 to the 180° position (FIG. 17C) allows the master pin 47 to move into a cut 100 in the set rod 58, to move below the shear interface 46 and thus into the C station blind hole 50, where it is retained by the opposed arcuate walls 91—91 (FIG. 2) as an inactive master pin 47. Rotation of the set rod 58 to the 270° position has the same result, as shown in FIG. 17D.

Series 101 of Set Rods 58 and Change Keys 35 Using six different set rods 58, the modified lock 32 can be rekeyed for use with a series 101 (FIG. 2) of eighteen different change keys 35 when six 2-depth master pins 47—47 are used as shown in FIG. 2. The series 101 of set rods 58 that render such modified lock 32 so rekeyable is defined in Chart 5 below and the one set rod 58 shown in FIG. 2 is one set rod of such series 101. The data in the column headed "Active Master Pin Positions" defines how many master pins 47—47 are active in a given one of the A through F stations. The M master key 61 is defined on the first line. For reference, the second line in Chart 5 corresponds to FIG. 18 where one 2-depth master pin 47 in each of stations A through C is active. The data in the column headed "Set Rod Sections" indicates the height H2 or Hϕ of the section 96 of the outer surface 97 at a particular one of the A through F stations at the designated set rod angular position for a given set rod 58. There, "2" indicates the A through C station heights H2 in FIG. 18 and "0" represents the height Hϕ (see FIG. 18, stations D through F). The data in the third line of Chart 5 is for the SR1 set rod 58 when it has been rotated 90° further to the 180° position shown in FIG. 19.

Chart 5 also defines the bittings 80—80 of the particular change keys 35—35 for which the modified lock 32 may be rekeyed when a particular set rod 58 is inserted in the slot 59. Thus, the 1 (or C1) first change key 36' has bittings 80—80 that have the following depths at respective A through F stations: 7,6,5,2,1,0. The "7" depth positions the one master pin 47 below the shear interface 46, whereas the master key 61 (designated as M) has an A station bitting that is 5, which is 2 less than that of the first or C1 change key 36', so that the A station master pin 47 is positioned above the shear interface 46, and thus in the housing pinway portion 40 when the plug 34 is unlocked and conditioned for rekeying. Reference to the other data in Chart 5 will enable one skilled in the art to provide desired contours on the other set rods 58 of the series 101 of set rods, and to cut the C2 through C18 change keys 35—35 for use with the modified lock 32 when a selected set rod 58 is inserted into the modified lock 32. Similarly, Chart 5 provides sufficient information for fabricating the SR2 through SR6 set rods.

It is to be understood that by exchanging one set rod 58 for another at random or by rotating a given set rod 58, there can be a random selection of the new (or second) change key 36" for which the modified lock 32 is now rekeyed.

CHART 5

| Data for Series 101 of Set Rods and Series of Change Keys for Use with Modified Lock | | | | | | | | | | | | | | | | | | | | |
|---|---|---|---|---|---|---|---|---|---|---|---|---|---|---|---|---|---|---|---|---|
| Active Master Pin Positions | | | | | | Set Rod | Set Rod Sections | | | | | | Set Rod Angular Position | Change Key Bittings | | | | | | Change Key |
| A | B | C | D | E | F | Number | A | B | C | D | E | F | (Degrees) | A | B | C | D | E | F | Number |
| | | | | | | | | | | | | | | 5 | 4 | 3 | 2 | 1 | 0 | M |
| 2 | 2 | 2 | | | | SR1 | 2 | 2 | 2 | 0 | 0 | 0 | 90° | 7 | 6 | 5 | 2 | 1 | 0 | C1 |
| 2 | 2 | | 2 | | | SR1 | 2 | 2 | 0 | 2 | 0 | 0 | 180° | 7 | 6 | 3 | 4 | 1 | 0 | C2 |
| 2 | 2 | | | 2 | | SR1 | 2 | 2 | 0 | 0 | 2 | 0 | 270° | 7 | 6 | 3 | 2 | 3 | 0 | C3 |
| 2 | 2 | | | | 2 | SR2 | 2 | 2 | 0 | 0 | 0 | 2 | 90° | 7 | 6 | 3 | 2 | 1 | 2 | C4 |
| 2 | | 2 | 2 | | | SR2 | 2 | 0 | 2 | 2 | 0 | 0 | 180° | 7 | 4 | 5 | 4 | 1 | 0 | C5 |
| 2 | | 2 | | 2 | | SR2 | 2 | 0 | 2 | 0 | 2 | 0 | 270° | 7 | 4 | 5 | 2 | 3 | 0 | C6 |
| 2 | | 2 | | | 2 | SR3 | 2 | 0 | 2 | 0 | 0 | 2 | 90° | 7 | 4 | 5 | 2 | 1 | 2 | C7 |
| 2 | | | 2 | 2 | | SR3 | 2 | 0 | 0 | 2 | 2 | 0 | 180° | 7 | 4 | 3 | 4 | 3 | 0 | C8 |
| 2 | | | 2 | | 2 | SR3 | 2 | 0 | 0 | 2 | 0 | 2 | 270° | 7 | 4 | 3 | 4 | 1 | 2 | C9 |
| 2 | | | | 2 | 2 | SR4 | 2 | 0 | 0 | 0 | 2 | 2 | 90° | 7 | 4 | 3 | 2 | 3 | 2 | C10 |
| | 2 | 2 | | 2 | | SR4 | 0 | 2 | 2 | 0 | 2 | 0 | 180° | 5 | 6 | 5 | 2 | 3 | 0 | C11 |

CHART 5-continued

Data for Series 101 of Set Rods and Series of Change Keys for Use with Modified Lock

| Active Master Pin Positions | | | | | | Set Rod | Set Rod Sections | | | | | | Set Rod Angular Position | Change Key Bittings | | | | | | Change Key |
|---|---|---|---|---|---|---|---|---|---|---|---|---|---|---|---|---|---|---|---|---|
| A | B | C | D | E | F | Number | A | B | C | D | E | F | (Degrees) | A | B | C | D | E | F | Number |
| | 2 | 2 | | | 2 | SR4 | 0 | 2 | 2 | 0 | 0 | 2 | 270° | 5 | 6 | 5 | 2 | 1 | 2 | C12 |
| | 2 | | 2 | 2 | | SR5 | 0 | 2 | 0 | 2 | 2 | 0 | 90° | 5 | 6 | 3 | 4 | 3 | 0 | C13 |
| | 2 | | 2 | | 2 | SR5 | 0 | 2 | 0 | 2 | 0 | 2 | 180° | 5 | 6 | 3 | 4 | 1 | 2 | C14 |
| | 2 | | | 2 | 2 | SR5 | 0 | 2 | 0 | 0 | 2 | 2 | 270° | 5 | 6 | 3 | 2 | 3 | 2 | C15 |
| | | 2 | 2 | | 2 | SR6 | 0 | 0 | 2 | 2 | 0 | 2 | 90° | 5 | 4 | 5 | 4 | 1 | 2 | C16 |
| | | 2 | | 2 | 2 | SR6 | 0 | 0 | 2 | 0 | 2 | 2 | 180° | 5 | 4 | 5 | 2 | 3 | 2 | C17 |
| | | | 2 | 2 | 2 | SR6 | 0 | 0 | 0 | 2 | 2 | 2 | 270° | 5 | 4 | 3 | 4 | 3 | 2 | C18 |

Also, certain set rods 58 can be made reversible, having the bevels 93 on each end 92 thereof. For example, the SR1 set rod 58 at 90° is reversible end-to-end with the SR7 set rod 68 at 180°, so that upon end-to-end reversal one set rod 58 could program the modified lock 32 for both the C1 and C18 change keys 35. The following pairs of change keys 35 could be programmed for using the same set rod 58 based on the data in Chart 5: C2 and C17; C3 and C15; C4 and C10; C5 and C16; C6 and C14; C7 and C9; C8 and C12; and C11 and C13.

Method of Rekeying Using Set Rod 58

Figure 12:
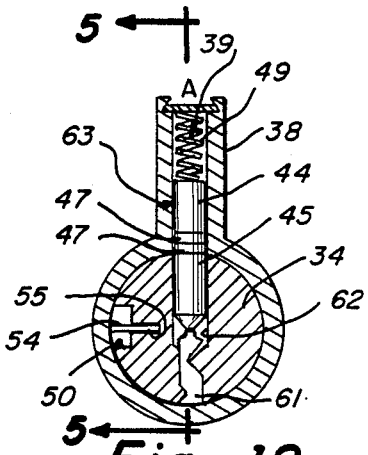

It may be appreciated that the method of rekeying the modified lock 32 can be performed three times without removal or exchange of the set rod 58, and that each of such three rekeying operations results in exclusive use of one change key 35 that is different from the other change keys 35. The method includes the steps of:

1. Use the master key 61 to unlock the modified lock 32. This puts all master pins 47—47 into the housing pinway portions 40—40 (as in FIG. 2).
2. Use the master key 61 to rotate the plug 34 to the rekeying position (FIG. 2).
3. Rotate the set rod 58 to any new 90°, 180° or 270° position, or for removal, to the 0° position.
4. If the set rod 58 is to be exchanged or reversed, the set rod 58 is removed from the modified lock 32 and is reversed or is replaced with another set rod 58 of the series 101 of set rods listed in Chart 5. Using the SR1 set rod 58 as an example, when it is rotated to the 180° position shown in FIG. 19 the A, B and D station master pins 47—47 are rendered active, and no other 2-depth master pins 47—47 are active.
5. The master key 61 is then used for rotating the plug 90° counterclockwise so that the plug 34 is returned to the original locking position (FIG. 12, shown for the set blade embodiment).

As noted, if it is desired to rekey the lock 32 to a change key combination that is not available using the SR1 set rod 58, the SR1 set rod 58 may be exchanged by rotating it to the 0° position and removing it from the groove 89. Another set rod 58 may be selected at random and inserted into the groove 89 in the 0° position. Thus, the set rods 58 of the series 101 of set rods have A through F sections with interrelated contours and may be used for randomly rekeying the modified lock 32 by making reference to Chart 5.

Modified Padlock Cylinder 33

Figure 21:
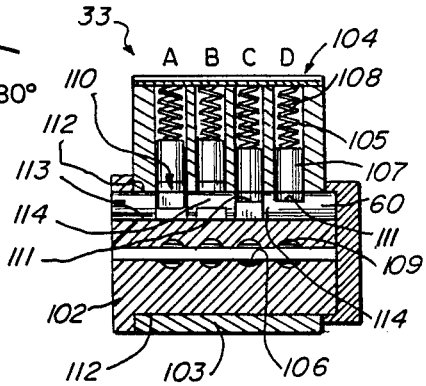
FIG. 21 is a transverse cross sectional view of a modified padlock cylinder showing the set rod of FIG. 20 selectably positioning master pins relative to a shear interface to rekey the padlock.

Referring now to FIG. 21,the pin tumbler padlock cylinder 33 is shown. A padlock cylinder plug 102 has been modified in the manner of the modified lock 32 of the present invention, so that the padlock cylinder 33 is referred to as the modified padlock cylinder 33.

The standard padlock cylinder 33 is shown in FIG. 21 with the plug 102 rotated about 45° in a housing 103 to a rekeying position. Four pinways 104—104 at stations A through D include housing pinway portions 105—105 and plug pinways portions 106—106. A driver pin 107 and a spring 108 are received in each housing pinway portion 105 and a tumbler pin 109 is received in each plug pinway portion 106. When the plug 102 is in an original or locked position similar to that shown in FIG. 11, the housing pinway portions 105—105 and the plug pinway portions 106—106 are aligned to form the A through D pinways 104—104. A master key, (not shown) is used to unlock the padlock cylinder 33 by moving master pins 47—47 above a shear interface 110 and thus, into the housing pinway portions 105—105. The plug 102 is then rotated into the rekeying position shown in FIG. 21.

The padlock cylinder 33 is modified according to the principles of the present invention by forming four blind holes (illustrated by the blind holes 111 at the C and D stations in FIG. 21) in an outer surface 112 of the plug 102 in the manner described with respect to the modified lock 32 shown in FIG. 2. Similarly, a U-shaped slot 113 is formed longitudinally in the plug 102 intersecting the blind holes 111—111, in the manner of the slot 59 shown in FIG. 2.

In the modified padlock cylinder 33 shown in FIG. 21, the set rod 60 is designed to be "non-removable" as compared to the set blade 54 and the set rod 58 shown in FIGS. 1 and 2 respectively. The non-removable design permits rekeying the modified padlock cylinder 33 for use of four different change keys 35 since all four outer longitudinal contours (at 0°, 90°, 180° and 270° as defined in FIG. 20) of an outer surface 114 of the set rod 60 may be used for rekeying without regard for having one longitudinal contour that is full height as at 0° in the removable set rod 58 shown in FIG. 2.

In particular, the four different longitudinal contours of the outer surface 114 are located at angularly spaced positions around a central axis 115 (FIG. 20) of the set rod 60. The angular positions are referenced from a vertical axis 116 (FIG. 20) and are at 0°, 90°, 180°, and 270° from such vertical axis 116. For convenience and as described below, the longitudinal contours of the outer surface 114 of the set rod 60 are set forth in Chart 6 below, where the angular positions are noted in terms of degrees and the longitudinal contours are designated with the A through D station letters.

CHART 6

| Active Master Pin Positions | | | | Set Rod Sections | | | | Change Key Bittings | | | | Change | Set Rod Angular |
|---|---|---|---|---|---|---|---|---|---|---|---|---|---|
| | | | | Definition of Set Rod 60 | | | | | | | | | |
| A | B | C | D | A | B | C | D | A | B | C | D | Key Number | Position (Degrees) |
| | | | | | | | | 3 | 2 | 1 | 0 | M | |
| 2 | 2 | | | 2 | 2 | 0 | 0 | 5 | 4 | 1 | 0 | C1 | 0° |
| 2 | | 2 | | 2 | 0 | 2 | 0 | 5 | 2 | 3 | 0 | C2 | 90° |
| | 2 | | 2 | 0 | 2 | 0 | 2 | 3 | 4 | 1 | 2 | C3 | 180° |
| | | 2 | 2 | 0 | 0 | 2 | 2 | 3 | 2 | 3 | 2 | C4 | 270° |

Figure 20:
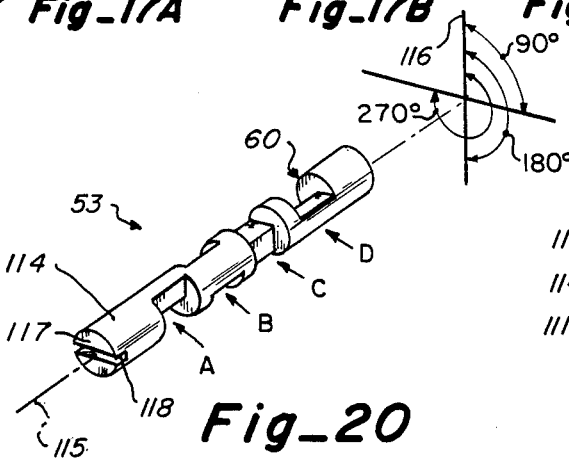
FIG. 20 is an enlarged view of a set rod for a pin tumbler type padlock cylinder, where the set rod is rotatable but not removable for rekeying the padlock.

The non-removable set rod 60 is shown in FIG. 20 having a front or external end 117 provided with a transverse slot 118. As in the other set rod 58, a tool such as a screwdriver (not shown) may be used to rotate the set rod 60 to select the particular rotary position desired for rekeying. Considering the 90° position of the set rod 60 shown in FIG. 20 (see arrows A through D), the "0" height Hϕ at the B and D station contours allows the master pins 47—47 at those station contours to be in the blind holes 111—111 at those stations, so that they will be inactive. In a similar manner, at the 180° position the B and D station master pins 47—47 will be active and the A and C station master pins 47—47 will be rendered inactive. At the 270° position, the set rod 60 will render only the C and D master pins 47—47 active. Referring in detail to FIG. 21 and to Chart 6, the set rod 60 is there shown in the 0° position such that the A and B master pins 47—47 will be active.

Method of Rekeying Padlock Cylinder 33 With Non-Removable Set Rod 60

It may be appreciated that the method of rekeying the modified lock 33 can be performed four times, and that each of such four rekeying operations results in exclusive use of one change key 35 that is different from the other change keys. The method includes the steps of:

1. Use the master key 61 to unlock the modified padlock cylinder 33. This puts all master pins 47—47 that were active into the housing pinway portions 105—105.
2. Use the master key 61 to rotate the plug 102 to the rekeying position (FIG. 21).
3. The set rod 60 is rotated to any new 0°, 90°, 180° or 270° position.
4. The master key 61 is then used for rotating the plug 102 counterclockwise so that the plug 102 is returned to the original locking position.

Thus, the provision of the set rod 60 renders the modified padlock cylinder 33 rekeyable four times without disassembly of the padlock cylinder 33 or removal or insertion of any master pins 47—47 or other parts therefrom or thereinto. If it is desired to enable rekeying of a standard padlock cylinder more than four times, the fourth embodiment of the set rod 58 can be used, in which the series 101 of exchangeable set rods 58 is used instead of the single, non-removable set rod 60; or the set blade embodiments, such as set blade 57, can be used.

Discussion of Features

The objects of the present invention are achieved in the pin tumbler locks disclosed, which are the modified, standard pin tumbler-type locks 32 and 33. The principles of the present invention may and 33. The principles of the present invention may be used in other types of pin tumbler locks. In all cases, the new features or modifications are easily provided by a relatively small number of machining steps. No extra tumbler or driver pins, such as 45 or 44 respectively, are used, thus no extra springs 49 are required. The keys used for rekeying are the master keys 61 or 84 that are available for use with all masterkeyed locks. Sub-master keying may also be provided. The rekeying operation in all embodiments is simple to accomplish. For more change keys 35, the rekeying is still simple in that the set blade 57 need only be reversed end-to-end, or for still more change keys, the set blade 57 need only be exchanged for different set blade 57 of the series 68. Since the set blades such as 54 are marked with identifications that correspond to the change key 35 for which the modified lock 32 is rekeyed, it is easy to select the correct change key after rekeying. Since the rendering inactive of an active master pin 47 requires a shallower depth bitting 80 of the second change key 36" and the rendering active of an inactive master pin 47 allows a deeper bitting 80 of the second change key 36" at the tumbler station at which the new master pin 47 is active, exclusive change keys 35—35 result from the programming or rekeying.

While the preferred embodiments have been described in order to illustrate the fundamental relationships of the present invention, it should be understood that numerous variations and modifications may be made to these embodiments without departing from the teachings and concepts of the present invention. Accordingly, it should be clearly understood that the form of the present invention described above and shown in the accompanying drawings is illustrative only and is not intended to limit the scope of the invention to less than that described in the following claims.

What is claimed is:

1. In a randomly programmable lock for use with a first change key and a second randomly selectable change key, said lock including latch means controlled by said lock, a housing, means movable in said housing for operating said latch means, said housing and said movable means having therein first pinway means for forming a plurality of first pinways intersected by a shear interface, said first pinway means having housing pinway portions extending in said housing, and first pin means received in said plurality of pinways for selective movement across said shear interface to prevent and permit movement of said movable means in said housing; the improvement comprising:

second pin means for randomly selectable movement across said shear interface;

second pinway means formed in said movable means corresponding to each of said first pinways means in said housing for receiving said second pin means; and means intersecting said second pinway means for randomly and selectively moving said second pin means across said shear interface into at least one randomly selectable one of said first pinways in said housing to interpose said randomly selectable one of said second pin means between said first pin means received in a randomly selectable one of said first pinways to require use of said randomly selectable second change key to permit movement of said movable means in said housing and to render said first change key ineffective to move said movable means in said housing.

2. A randomly programmable lock according to claim 1, in which:

said second pin means includes at least one master pin received in each of said second pinway means formed in said movable means; and said means for randomly and selectively moving is at least one set blade having a predetermined contour that is related to the bitting of the second randomly selectable change key for moving at least said randomly selectable one of said master pins across said shear interface into said one of said first means to render said first change key ineffective to move said movable means in said housing.

3. A randomly programmable lock according to claim 1, in which:

said second pin means includes at least one master pin received in said second pinway means formed in said movable means;

said second pinway means formed in said movable means includes a plurality of magazines, each of said magazines being adapted to receive one of said master pins; and said means for randomly and selectively moving is at least a first elongated member having a predetermined irregular contour for engaging said master pins in said magazines, said member intersecting each of said second pinway means for moving at least a randomly selectable one of said master pins across said shear interface into said one of said first pinway means.

4. A randomly programmable lock according to claim 3, in which:

said means for randomly and selectively moving includes an elongated opening extending into said movable means from the front thereof and intersecting each of said magazines; and there are a plurality of said elongated members, each of said elongated members being adapted for movement from said front of said movable means into said elongated opening, each of said elongated members having an elongated surface provided with sections designed for selectively moving certain of said master pins out of said magazines, one said section being aligned with each of said first pinway means in said housing, said sections having heights selected in accordance with the bitting pattern of said randomly selectable second change key such that when a second one of said elongated members is received in said elongated opening said randomly selectable one of said master pins is moved by the corresponding one of said sections across said shear interface into said one of said first pinway means to permit movement of said movable means in said housing using said second randomly selectable change key and to prevent said first change key from permitting said movement of said movable means in said housing.

5. A randomly programmable lock according to claim 4, in which:

said second pinway means formed in said movable means is formed therein angularly spaced from said first pinway means in said movable means; and master key means are provided for positioning all of said second pin means in said housing pinway portions for permitting movement of said movable means to align said second pinway means with said housing pinway portions of said first pinway means to condition all of said second pin means for movement across said shear interface;

one of said elongated members being provided for each change key with which it is desired to operate said lock, said surface of a particular one of said elongated members having said heights corresponding to the particular bitting heights of a particular one of said change keys so that at least one different one of said randomly selectable master pins is moved across said shear interface according to which of said elongated members is inserted into said elongated opening to require use of a different one of said change keys to unlock said lock;

said master key means being adapted to move said movable means back to its original position to reform said plurality of first pinways so that said different one of said randomly selectable master pins that was moved across said shear interface is now received in a randomly selected one of said first pinways to require use of said particular one of said change keys to permit movement of said movable means to operate said latch means.

6. A randomly programmable lock according to claim 5, in which:

each said elongated member is provided with a hole at the front end thereof; and means is provided for engaging said hole and removing said elongated member from said elongated opening to facilitate insertion of a different one of said elongated members in said elongated opening to facilitate said random programming of said lock.

7. A randomly rekeyable lock according to claim 2, in which:

said lock is a standard pin tumbler lock that is modified to provide said improvement;

said housing pinways portions are axially spaced in said housing;

said movable means is a plug rotatable in said housing from an original position forming said first pinways;

said second pinway means includes a plurality of longitudinally-spaced, short recess formed in the outer surface of said plug, there being one such short recess corresponding to each said housing pinway portion;

said second pin means includes at least one master pin adapted to be received in each said short recess for randomly selected movement out of said short recess across said shear interface into a randomly selected one of said housing pinway portions when said plug has been rotated from said original position to align said recesses with said housing pinway portions of said housing;

said randomly and selectively moving means includes a slot formed axially in said plug and intersecting each said short recess, said moving means further including a plurality of set blades wherein one of said set blades is designed for use with a corresponding one of said change keys, each set blade being adapted to slide into said slot and having an edge thereon that has a preselected axially extending contour including a plurality of selected bittings each having a predetermined height at a given axial location aligned with said short holes, said bittings being adapted to engage at least one randomly selectable master pin received in one said recess and to move said engaged master pin across said shear interface so that upon rotation of said plug back to said original position to form said first pinways, said randomly selected master pin is retained in said first pinway so that the change key corresponding to said set blade must be used to permit movement of said plug in said housing and to prevent said first change key from moving said plug in said housing.

8. A randomly programmable lock according to claim 1, in which:

said first pinway means also has first pinway portions in said movable means;

said second pin means includes at least one master pin received in each of said second pinway means formed in said movable means; and said means for randomly and selectively moving includes at least one rod received in said movable means and spaced from said first pinway portion, said rod having an outer surface for controlling the position of each said master pin relative to said shear interface, said surface having axially spaced sections axially aligned with said housing pinway portions of said first pinway means, the heights of said axially spaced sections being selected to position at least one randomly selectable master pin on the housing side of said shear interface according to the bittng pattern of said randomly selectable second change key for rekeying said lock for use only with said second change key.

9. A randomly programmable lock according to claim 8 in which:

said means for randomly moving also includes a series of blind holes axially aligned with said housing pinway portions and angularly spaced from said first pinway portion of said first pinway means;

said rod intersecting each of said blind holes;

a first one of said sections of said outer surface of said rod being aligned with one of said blind holes so that a first of said master pins engaged by said first section is positioned on the housing side of said shear interface;

said rod having at least a second other section corresponding to each of said other blind holes, each of said second other sections having a height relative to said shear interface that is different from said height of said first section of said outer surface, said master pins in said other blind holes engaging said second other sections and remaining in said blind holes to remain on the other side of said shear interface so that when said movable means is moved in said housing to reform said first pinway means said first master pin is in said first pinway means.

10. A randomly programmable lock according to claim 4, in which:

said second pinway means formed in said movable means is formed therein angularly spaced from said first pinway means in said movable means; and master key means are provided for positioning all of said second pin means in said housing pinway portions for permitting movement of said movable means to align said second pinway means with said housing pinway portions of said first pinway means to condition all of said second pin means for movement across said shear interface;

said means for randomly moving includes one said elongated member in the form of a rod having a plurality of axially and angularly spaced master pin position control surfaces, a first group of said master pin control surfaces being axially aligned for rekeying said lock for use with said first change key, a second group of said master pin control surfaces being angularly spaced from said first group for rekeying said lock for use with said second changekey, said first and second groups of master pin control surfaces having heights corresponding to different bitting heights of said first and second change keys so that at least one different one of said randomly selectable master pins is moved across said shear interface according to which of said first or second groups of master pin control surfaces is aligned with said secodn pinway means to require use of a different one of said first and second change keys to unlock said lock;

said master key means being adapted to move said movable means back to its original position to reform said plurality of first pinways so that said different one of said randomly selectable master pins that was moved across said shear interface is now received in a randomly selected one of said first pinways to require use of a unique one of said first and second change keys for moving said movable means to operate said latch.

11. A randomly programmable lock according to claim 1, in which:

said lock is a standard pin tumbler lock that is modified to provide said improvement;

said housing pinways portions are axially spaced in said housing;

said movable means is a plug rotatable in said housing from an original position forming said first pinways;

said second pinway means includes a plurality of longitudinally-spaced, short recesses formed in the outer surface of said plug, there being one such short recess corresponding to each said housing pinway portion;

said second pin means includes at least one master pin adapted to be received in each said short recess for randomly selected movement out of said short recess across said shear interface into a randomly selected one of said housing pinway portions when said plug has been rotated from said original position to align said recesses with said housing pinway portions of said housing;

said randomly and selectively moving means includes a slot formed longitudinally in said plug and intersecting each said short recess, said moving means further including a rod rotatably received in said slot and having a section received in each said short recess, each said section having an outer surface provided with a circumferential contour selected in a predetermined manner relative to that of the other said sections so that upon rotation of said rod in said slot to face a given side of said rod toward said housing pinway portions, said sections received in said recess have a corresponding given side of said contours facing said housing pinway portions, said given sides of said contours being in or out of said respective recesses according to said selected contour, said given side of said contour that is in a given one of said recesses being effective to position said master pin out of said given recess and across said shear interface into said housing pinway portion that is opposite to said given recess for rekeying said lock.

12. A randomly programmable lock according to claim 11, in which:

said slot extends to the front of said plug;

said rod receivedin said slot has an end adjacent said front of said plug, said end being provided with a transverse slot adapted to receive a tool that is used for rotating said rod to face a given side thereof toward said housing pinway portions.

13. A randomly programmable lock according to claim 11, in which:

said rod is provided with a first end having a sloped leading edge to facilitate insertion of said first end of said rod into said slot after assembly of said lock.

14. A randomly programmable lock according to claim 13, in which:

said rod is insertable into said slot when said plug is rotated to align said recesses with said housing pinway portions, said sloped leading edge being effective to remove said master pins from said recesses as said rod is inserted into said slot; and said contoured sections in each said recess being effective to control the return of selected master pins into selected ones of said recesses to rekey said lock.

15. A randomly programmable lock according to claim 13, in which:

said sections of said rod are differently contoured from said first end of said rod to a second end of said rod than from said second end to said first end;

said rod having a sloped rear edge at said second end to facilitate insertion of said second end of said rod into said slot to provide additional rekeying combinations to said lock with the same rod; and said sloped rear end having a transverse slot therein adapted to receive a tool that is used for rotating said rod to face a given side thereof toward said housing pinway portions.

16. A randomly programmable lock according to claim 1, in which:

said movable means is movable in said housing to align said second pinway means with said housing pinway portions to form a plurality of second pinways; and said moving means moves said second pin means across said shear interface into one of said housing pinway portions so that upon movement of said movable means to reform said first pinways said second pin means that was moved across said shear interface is in one of said first pinways to render said lock randomly reprogrammed; said randomly and selectively moving means being designed to remain in intersection with said second pinway means so that when said second pinways become formed during operation of said lock said moving means prevents said first pin means from entering said second pinway means.

17. A lock according to claim 1, in which:

two of said second pin means and said second pinway means are provided in said movable means, each of said second pinway means being angularly spaced from said first pinway means; and two of said moving means are provided, one intersecting each of said second pinway means.

18. In a lock including a housing: a bore extending through said housing parallel to an axis; a plug having a cylindrical surface and being received in said bore; said housing and said plug defining a shear interface and each having a first set of axially aligned holes therein forming portions of and combining to form a plurality of pinways that are axially spaced and that are divided by said shear interface; said plug being rotatably received in said bore; a first tumbler stack including a first tumbler pin, a first active driver pin and at least one first master pin being received in a first of said pinways; said first master pin separating said first driver pin from said first tumbler pin; a second tumbler stack in a second of said second pinways and including a second driver pin and a second tumbler pin; and a keyway formed in said cylindrical surface of said plug; the improvement comprising:

said plug having a second set of axially aligned and spaced holes therein that are angularly spaced from said first set of holes in said plug, said second set of holes being alignable with said first set of holes in said housing upon rotation of said plug in said bore;

said plug having a slot extending axially therein and intersecting each hole of said second set of holes;

at least one second master pin, said second master pin being inactive when received in one of said holes of said second set of holes in axial alignment with said second tumbler stack and being active when received in said second tumbler stack; and a first set member receivable in said slot, said member having at least one master pin position control surface thereon, said surface having one section for each hole of said second set of axially spaced holes, a first of said sections being axially aligned with said first driver pin and having a height relative to said shear interface so that said first master pin associated with said first driver pin is positioned in said hole of said second set of holes to render said first master pin inactive, one of said sections being axially aligned with said second driver pin and having a height relative to said shear interface so that said second master pin is positioned on said housing side of said shear interface adjacent said second driver pin so that upon rotation of said plug in said bore to reform said pinways said first master pin is inactive and not in said first tumbler stack and said second master pin is active in said second tumbler stack.

19. A lock apparatus including a lock according to claim 18, and further including:

a master key insertable in said keyway and having bittings for positioning said first and second active master pins on the housing side of said shear interface for unlocking said lock and conditioning said active master pins to be rendered inactive or to be active again.

20. A lock apparatus according to claim 19, in which:

said first set member has a second master pin control surface thereon at a second angular position and having a first section axially aligned with said first driver pin and a second section axially aligned with said second driver pin, said first section of said second surface having a height for rendering said first master pin active, said second section of said second surface having a height for rendering said second master pin inactive.

21. A lock apparatus according to claim 19, in which:
said first set member is removable from said slot and is insertable therein from each opposite end thereof, said first and second sections of said control surface having different axial positions according to which said end of said first set member is first inserted into said slot.

22. A lock apparatus according to claim 19, in which:
a second set member is receivable in said slot, said member having at least one master pin position control surface thereon, said surface having first and second sections corresponding in axial location to said first and second sections of said first set member, the height of at least one of said first and second sections of said second set member being different from the height of at least one of said first and second sections of said first set member.

23. A lock apparatus according to claim 19, in which:
said set member is a narrow blade having an edge that forms said control surface.

24. A lock apparatus according to claim 19, in which:
said set member is a rod having a plurality of said control surfaces extending axially thereon, said surfaces being formed thereon at angularly spaced locations.

25. A lock apparatus according to claim 19, in which:
said set member has means formed in at least one end thereof for removing said set member from said slot and for rotating said set member when it is received in said slot.

26. A lock apparatus according to claim 19, in which:
a plurality of set members are provided, each of said set members being the same as said first set member except for the contour of said control surfaces thereon, the contour of said control surfaces of each of said first and plurality of set members being different.

27. A lock apparatus according to claim 26, in which:
one change key is provided to correspond to each of said first and plurality of set members, each of said change keys having bittings selected according to said control surface contour of said corresponding set member for unlocking said lock.

28. A lock according to claim 18, in which:
said plug has a third set of axially aligned and spaced holes therein that are angularly spaced from said first and second sets of holes in said plug, said third set of holes being alignable with said first set of holes in said housing upon rotation of said plug in said bore;
said plug having a second slot extending axially therein and intersecting each hole of said third set of holes;
at least one third master pin, said third master pin being inactive when received in one of said holes of said third set of holes in axial alignment with said second tumbler stack and being active when received in said second tumbler stack;
a second set member receivable in said second slot, said second member having at least one master pin position control surface thereon, said surface having one control section for each hole of said third set of axially spaced holes, a first of said control sections being axially aligned with said first driver pin and having a height relative to said shear interface so that one of said third master pins associated with said first driver pin is positioned in said hole of said third set of holes to render said third master pin inactive, one of said control sections being axially aligned with said second driver pin and having a height relative to said shear interface so that one of said third master pins is positioned on said housing side of said shear interface adjacent said second driver pin so that upon rotation of said plug in said bore to re-form said pinways said third master pin in said first tumbler stack is inactive and not in said first tumbler stack and said third master pin adjacent said second driver pin is active in said second tumbler stack.

29. A lock according to claim 28, in which:
said first and second master pins have a first depth and said third master pins have a second depth different from said first depth; and
said first and second set members have said control surfaces selected for use with said different depth first and second master pins and said third master pins.

30. In an apparatuds for rekeying a standard pin tumbler lock for use with a randomly selected second change key and not with a first change key, said rekeying being by randomly relocating master pins between the pins in a plurality of pinways of said pin tumbler lock that has a shear interface that is not penetrated by any of said pins to enable the lock to be operated, at least one of said master pins initially being active and located between the driver and tumbler pins in a first of said pinways and being transferrable to inactive status out of said first pinway, a second of said master pins initially being inactive and out of a randomly selected second one of said pinways and being movable to an active position between the driver and tumbler pins in said second randomly selected one of said pinways in the rekeying of said lock, said pinways forming a first set of axially aligned pinways, said lock having a plug provided with means angularly spaced from said first set of pinways for receiving said inactive master pins, said plug being movable so as to align said receiving means with the driver pins of said pinways; the improvement comprising:
means extending axially and intersecting said receiving means for selectively and randomly moving said master pins into and out of said receiving means to selectively and randomly position said master pins relative to said shear interface so that said active and inactive master pins are randomly positioned on one or the other side of said shear interface into either said active or said inactive position to render said lock usable with said randomly selected second one of said change keys and not usable with said first change key.

31. An apparatus according to claim 30, which further includes:
said plug having a keyway radially aligned with said first set of pinways;
master key means insertable in said keyway for locating said active master pins on the driver pin side of said shear interface to unlock said lock and permit rotation of said plug to align said receiving means with said driver pins; and
said moving means includes a slot intersecting said receiving means and an elongated member having a bevel at one end thereof, said member being insertable in said slot so that said master pins engage said bevel and ride onto said member, said member having a master pin control surface for each of said first and second pinways for selectively rendering said master pins active or inactive to rekey said lock.

32. An apparatus according to claim 31, in which:

said moving means includes two of said members, a first said member having said surfaces for rendering said first master pin active and said second master pin inactive, a second said member having said surfaces for rendering said first master pin inactive and said second member active.

33. An apparatus according to claimm 36, in which:

said moving means includes said elongated member in the form of a set rod having at least two of said control surfaces angularly spaced thereon, wherein said control surfaces at one angular position are different from those at another angular position so that said lock is rekeyable by rotating said elongated means.

34. An apparatus according to claim 31, in which:

said elongated member is reversible in said slot to provide a different key setting according to which end of said member is the leading end as said member is inserted into said slot, a given one of said pinways being aligned with a different one of said master pin control surfaces depending on which of said ends is said leading end.

35. A method of randomly programming a lock that includes latch means controlled by said lock, a housing, means movable in said housing for operating said latch means, said housing and said movable means having therein first pinway means for forming a plurality of pinways intersected by a shear interface, first pin means received in said plurality of pinways for selective movement across said shear interface to prevent and permit movement of said movable means in said housing in response to use of first and second different, randomly selectable change keys, and second pinway means in said movable means for receiving master pins that are adapted for randomly selectable movement into said first pinway means of said housing; comprising the steps of:

with said first pinway means formed, moving all if any, master pins therein into said first pinways means of said housing, said moving including moving at least a first master pin that was in a first of said pinways into said first pinway means of said housing;

moving said movable means from an original position to move said second pinway means into alignment with said first pinway means of said housing while retaining said moved master pins in said first pinway means of said housing;

moving at least one randomly selected master pin into a second of said pinways of said first pinway means of said housing and moving said first master pin into said second pinway means aligned with said first pinway to render said first master pin inactive; and moving said movable means back to said original position to position said one randomly selected master pin in said second pinway of said first pinway means to render said one master pin active and said first change key ineffective and to render said randomly selectable second change key effective to cause movement of said movable means in said housing to operate said latch means.

36. A method according to claim 35, in which:

said second change key must have a shallower bitting aligned with said first pinway and has a deeper bitting aligned with said second pinway.

37. A method of rendering a standard pin tumbler lock randomly rekeyable for use with a plurality of different, randomly selectable change keys, said rekeying being without disassembling said lock each time said lock is rekeyed for a different one of said change keys, wherein said lock is initially designed so that the initially intended rekeying can be performed only upon disassembly of said lock; said lock including a housing; a bore extending axially through said housing to define a shear interface; a plug received in said bore; said housing and said plug having aligned holes therein forming at least first and second pinways that are axially spaced along said plug and that are divided by said shear interface; said plug being rotatably received in said bore, said method of rendering said lock integrally rekeyable comprising the steps of:

removing said plug from said bore;

forming a plurality of blind holes in the outer surface of said plug axially aligned with said pinways, the depth of each of said plurality of blind holes being sufficient to receive a master pin;

forming a groove extending axially from the front of said plug axially and intersecting each of said blind holes;

inserting at least one master pin in each said blind hole;

providing a member adapted to be received in said groove and having a contour for randomly and selectively positioning one of said master pins on the housing side of said shear interface in one of said holes in said housing or on the plug side of said shear interface for being received in one of said blind holes; and replacing said plug in said bore.

38. A method of rekeying a lock that has been rendered rekeyable for use with different change keys as recited in claim 37, which comprises the steps of:

providing a master key having bittings along one edge for unlocking said lock with any of said master pins as are in said pinways being above said shear interface;

inserting said master key into said keyway with said pinways formed;

rotating said plug from an original position to align said blind holes with said holes in said housing;

inserting said member into said groove;

rotating said plug to said original position; and removing said master key from said keyway with said member remaining in said groove for rendering said lock usable only with said randomly selectable change key.

39. A method of rekeying a lock accordig to claim 38, in which:

said providing step provides one of said members corresponding to each of said different change keys, each member having a different contour; and said rekeying of said lock for use of a second change key instead of a first change key for which said lock is set includes the step of removing a first one of said members from said groove before performing said inserting step to insert a second one of said members into said groove.

40. A method of rekeying a lock for use with a plurality of different change keys and a single master key without disassembling the lock, said lock including a housing; a bore extending through said housing to define a shear interface; a plug received in said bore and having a keyway that extends therein from the outer surface thereof, said housing and said plug having aligned holes therein forming at least first and second pinways that are spaced it the direction in which said bore extends through said housing and that are divided by said shear interface; a groove formed in said outer surface of said plug angularly spaced from said first and second pinways and said keyway, a series of blind holes each having a depth and diameter sufficient to receive a master pin, at least one master pin being received in said blind hole aligned with said second pinway; said plug being received in said bore for rotation from a first position at which said aligned holes form said pinways to a rekeying position at which said blind holes are aligned with said holes in said housing; a first pin stack including a first tumbler pin, at least one master pin and a first driver pin received in said first pinway, and a second pin stack in said second pinway and including a second driver pin and a second tumbler pin; said method comprising the steps of:

inserting into said keyway a master key having bittings for unlocking said lock and positioning said master pin in said housing hole;

rotating said plug to said rekeying position;

inserting into said groove a master pin transfer member, said member having sections thereon axially aligned with said blind holes, said sections having a given pattern for selectively transferring said master pins across said shear interface to insert a master pin in said second pin stack and remove said master pin from said first pin stack;

rotating said plug back to said first position with said housing and plug holes in alignment and said master pin in said second pin stack; and removing said master key from said keyway to require use of said rekeyed lock with a second change key.

41. A method of rekeying the lock defined in claim 40 after said rekeying according to claim 8, including the further steps of:

reinserting said master key into said keyway and rotating said plug to said rekeying position;

rotating said master pin transfer member to render said sections effective to transfer different ones of said master pins across said shear interface;

rotating said plug back to said first position; and removing said master key from said keyway to require use of said rekeyed lock with a third change key.

42. A method of rekeying the lock defined in claim 40 including the further steps of:

reinserting said master key into said keyway and rotating said plug to said rekeying position;

removing said master pin transfer member from said groove;

inserting a second master pin transfer member into said groove, said second member having a pattern of sections thereon that is different from said given pattern for selectively transferring different ones of said master pins across said shear interface;

rotating said plug back to said first position; and removing said master key from said keyway to require use of said rekeyed lock with a third change key.

43. A lock comprising:

a housing;

a bore extending through said housing parallel to an axis;

a plug having a cylindrical surface and being received in said bore;

said bore of said housing and said cylindrical surface of said plug defining a shear interface;

said housing having a single series of holes therein;

said plug having first and second series of holes therein, said series of plug holes being angularly spaced from each other, said housing holes and said first series of plug holes being alignable and combining to form a plurality of pinways that are spaced in the direction of said axis and that are divided by said shear interface;

said plug being rotatably received in said bore between a first locking position at which said pinways are formed and a second rekeying position at which said second series of holes aligns with said housing holes;

a first tumbler stack including a first tumbler pin and a first driver pin being received in a first pinway;

a second tumbler stack in a second pinway and including a second driver pin and a second tumbler pin;

a keyway formed in said plug and extending from said first series of holes in said plug to said cylindrical surface of said plug;

at least one master pin initially received in each said hole of said second series of holes in said plug;

a slot extending in said plug in the direction of said axis and intersecting each said hole of said second series of holes; and an elongated member insertable into said slot and having a surface for selectably and randomly positioning one or more of said master pins on one side of said shear interface when said second series of plug holes is aligned with said series of housing holes so that said positioned master pin is an active pin stack pin in a selected housing hole for retention therein when said plug is rotated to said unlocking position, whereupon said active master pin is positioned between said tumbler and said driver pins of the pin stack in said pinway that contains said pin stack.

44. A lock apparatus including a lock as recited in claim 43, wherein:

said lock has six of said pinways provided at stations designated A through F;

said lock initially having 2-depth master pins received in each said hole of said second series of holes;

a plurality of said elongated members is provided, said surface of each said members being divided into sections corresponding to said A through F stations, each said section of a particular member having a height as defined in the following list; and a plurality of change keys is provided for random selection from the following change keys, said change keys have bittings related as follows to said arrangement of master pin control surfaces on said elongated members, a given one of said change keys being usable to unlock said lock when a corresponding one of said members is inserted into said slot;

| Heights of Surface of Member | | | | | | Change Key/ Member | Change Key Bittings | | | | | |
|---|---|---|---|---|---|---|---|---|---|---|---|---|
| A | B | C | D | E | F | I.D. | A | B | C | D | E | F |
| | | | | | | M | 5 | 4 | 3 | 2 | 1 | 0 |
| 2 | | | | | | | | | | | | |
| 2 | | | | | | C1 | 9 | 4 | 3 | 2 | 1 | 0 |
| 2 | 2 | | | | | C2 | 7 | 6 | 3 | 2 | 1 | 0 |
| 2 | | 2 | | | | C3 | 7 | 4 | 5 | 2 | 1 | 0 |
| 2 | | | 2 | | | C4 | 7 | 4 | 3 | 4 | 1 | 0 |
| 2 | | | | 2 | | C5 | 7 | 4 | 3 | 2 | 3 | 0 |
| 2 | | | | | 2 | C6 | 7 | 4 | 3 | 2 | 1 | 2 |
| | 2 | | | | | | | | | | | |
| | 2 | | | | | C7 | 5 | 8 | 3 | 2 | 1 | 0 |
| | 2 | 2 | | | | C8 | 5 | 6 | 5 | 2 | 1 | 0 |
| | 2 | | 2 | | | C9 | 5 | 6 | 3 | 4 | 1 | 0 |
| | 2 | | | 2 | | C10 | 5 | 6 | 3 | 2 | 3 | 0 |
| | 2 | | | | 2 | C11 | 5 | 6 | 3 | 2 | 1 | 2 |
| | | 2 | | | | | | | | | | |
| | | 2 | | | | C12 | 5 | 4 | 7 | 2 | 1 | 0 |
| | | 2 | 2 | | | C13 | 5 | 4 | 5 | 4 | 1 | 0 |
| | | 2 | | 2 | | C14 | 5 | 4 | 5 | 2 | 3 | 0 |
| | | 2 | | | 2 | C15 | 5 | 4 | 5 | 2 | 1 | 2 |
| | | | 2 | | | | | | | | | |
| | | | 2 | | | C16 | 5 | 4 | 3 | 6 | 1 | 0 |
| | | | 2 | 2 | | C17 | 5 | 4 | 3 | 4 | 3 | 0 |
| | | | 2 | | 2 | C18 | 5 | 4 | 3 | 4 | 1 | 2 |
| | | | | 2 | | | | | | | | |
| | | | | 2 | | C19 | 5 | 4 | 3 | 2 | 5 | 0 |
| | | | | 2 | 2 | C20 | 5 | 4 | 3 | 2 | 3 | 2 |
| | | | | | 2 | | | | | | | |
| | | | | | 2 | C21 | 5 | 4 | 3 | 2 | 1 | 4 |

45. A lock apparatus including a lock according to claim 43, in which:

a third series of holes is provided in said plug;

said housing holes and said third series of holes being alignable;

another slot is provided extending in said plug in the direction of said axis and intersecting each said hole of said third series of holes;

said lock has six of said pinways provided at stations designated A through F;

said lock initially having one 2-depth master pin received in each said hole of said second series of holes and one 3-depth master pin received in each said hole of said third series of holes;

a plurality of said elongated members is provided, said surface of each said members being divided into sections corresponding to said A through F stations, each said section of a particular member having a height as defined in Chart 1 below, said elongated members listed as "SB" plus a number being used for positioning said 2-depth master pins and said elongated members listed as "S" plus a range of numbers being used for positioning said 3-depth master pins;

a plurality of change keys is provided for random selection from the change keys listed in Chart 1 below, said change keys have bittings related as set forth in Chart 1 below to said arrangement of master pin control surfaces on said elongated members, a given one of said change keys being usable to unlock said lock when a corresponding one of said members is inserted into said slot; and a set of sub-master keys for use with said lock, certain ones of said sub-master keys being usable with certain of said change keys as defined in Chart 2 below:

CHART 1

| Heights of Surface of Member | | | | | | | | Change Key Bittings | | | | | |
|---|---|---|---|---|---|---|---|---|---|---|---|---|---|
| A | B | C | D | E | F | Member I.D. | Change Key I.D. | A | B | C | D | E | F |
| 2 | | | | | | SB1 | | | | | | | |
| 3 | | | | | | S1-6 | C1 | 5 | 4 | 3 | 2 | 1 | 0 |
| | | | | | | SB2 | | | | | | | |
| 3 | 2 | | | | | S1-6 | C2 | 3 | 6 | 3 | 2 | 1 | 0 |
| | | | | | | SB3 | | | | | | | |
| 3 | | 2 | | | | S1-6 | C3 | 3 | 4 | 5 | 2 | 1 | 0 |
| | | | | | | SB4 | | | | | | | |
| 3 | | | 2 | | | S1-6 | C4 | 3 | 4 | 3 | 4 | 1 | 0 |
| | | | | | | SB5 | | | | | | | |
| 3 | | | | 2 | | S1-6 | C5 | 3 | 4 | 3 | 2 | 3 | 0 |
| | | | | | | SB6 | | | | | | | |
| 3 | | | | | 2 | S1-6 | C6 | 3 | 4 | 3 | 2 | 1 | 2 |
| | | | | | | SB1 | | | | | | | |
| 2 | 3 | | | | | S7-12 | C7 | 2 | 7 | 3 | 2 | 1 | 0 |
| | 2 | | | | | SB2 | | | | | | | |
| | 3 | | | | | S7-12 | C8 | 0 | 9 | 3 | 2 | 1 | 0 |
| | | | | | | SB3 | | | | | | | |
| | 3 | 2 | | | | S7-12 | C9 | 0 | 7 | 5 | 2 | 1 | 0 |
| | | | | | | SB4 | | | | | | | |
| | 3 | | 2 | | | S7-12 | C10 | 0 | 7 | 3 | 4 | 1 | 0 |
| | | | | | | SB5 | | | | | | | |
| | 3 | | | 2 | | S7-12 | C11 | 0 | 7 | 3 | 2 | 3 | 0 |
| | | | | | | SB6 | | | | | | | |
| | 3 | | | | 2 | S7-12 | C12 | 0 | 7 | 3 | 2 | 1 | 2 |
| | | | | | | SB1 | | | | | | | |
| 2 | | 3 | | | | S13-18 | C13 | 2 | 4 | 6 | 2 | 1 | 0 |
| | | | | | | SB2 | | | | | | | |
| | 2 | 3 | | | | S13-18 | C14 | 0 | 6 | 6 | 2 | 1 | 0 |
| | | 2 | | | | SB3 | | | | | | | |
| | | 3 | | | | S13-18 | C15 | 0 | 4 | 8 | 2 | 1 | 0 |
| | | | | | | SB4 | | | | | | | |
| | | 3 | 2 | | | S13-18 | C16 | 0 | 4 | 6 | 3 | 1 | 0 |
| | | | | | | SB5 | | | | | | | |
| | | 3 | | 2 | | S13-18 | C17 | 0 | 4 | 6 | 2 | 3 | 0 |
| | | | | | | SB6 | | | | | | | |
| | | 3 | | | 2 | S13-18 | C18 | 0 | 4 | 6 | 2 | 1 | 2 |

CHART 1-continued

| Heights of Surface of Member | | | | | | | | Change Key Bittings | | | | | |
|---|---|---|---|---|---|---|---|---|---|---|---|---|---|
| A | B | C | D | E | F | Member I.D. | Change Key I.D. | A | B | C | D | E | F |
| | | | | | | SB1 | | | | | | | |
| 2 | | | 3 | | | S19-24 | C19 | 2 | 4 | 3 | 5 | 1 | 0 |
| | | | | | | SB2 | | | | | | | |
| | 2 | | 3 | | | S19-24 | C20 | 0 | 6 | 3 | 5 | 1 | 0 |
| | | | | | | SB3 | | | | | | | |
| | | 2 | 3 | | | S19-24 | C21 | 0 | 4 | 5 | 5 | 1 | 0 |
| | | | 2 | | | SB4 | | | | | | | |
| | | | 3 | | | S19-24 | C22 | 0 | 4 | 3 | 5 | 3 | 0 |
| | | | | | | SB5 | | | | | | | |
| | | | 3 | 2 | | S19-24 | C23 | 0 | 4 | 3 | 5 | 3 | 0 |
| | | | | | | SB6 | | | | | | | |
| | | | 3 | | 2 | S19-24 | C24 | 0 | 4 | 3 | 5 | 1 | 2 |
| | | | | | | SB1 | | | | | | | |
| 2 | | | | 3 | | S25-30 | C25 | 2 | 4 | 3 | 2 | 4 | 0 |
| | | | | | | SB2 | | | | | | | |
| | 2 | | | 3 | | S25-30 | C26 | 0 | 6 | 3 | 2 | 4 | 0 |
| | | | | | | SB3 | | | | | | | |
| | | 2 | | 3 | | S25-30 | C27 | 0 | 4 | 5 | 2 | 4 | 0 |
| | | | | | | SB4 | | | | | | | |
| | | | 2 | 3 | | S25-30 | C28 | 0 | 4 | 3 | 4 | 4 | 0 |
| | | | | 2 | | SB5 | | | | | | | |
| | | | | 3 | | S25-30 | C29 | 0 | 4 | 3 | 2 | 6 | 0 |
| | | | | | | SB6 | | | | | | | |
| | | | | 3 | 2 | S25-30 | C30 | 0 | 4 | 3 | 2 | 4 | 2 |
| | | | | | | SB1 | | | | | | | |
| 2 | | | | | 3 | S31-36 | C31 | 2 | 4 | 3 | 2 | 1 | 3 |
| | | | | | | SB2 | | | | | | | |
| | 2 | | | | 3 | S31-36 | C32 | 0 | 6 | 3 | 2 | 1 | 3 |
| | | | | | | SB3 | | | | | | | |
| | | 2 | | | 3 | S31-36 | C33 | 0 | 4 | 5 | 2 | 1 | 3 |
| | | | | | | SB4 | | | | | | | |
| | | | 2 | | 3 | S31-36 | C34 | 0 | 4 | 3 | 4 | 1 | 3 |
| | | | | | | SB5 | | | | | | | |
| | | | | 2 | 3 | S31-36 | C35 | 0 | 4 | 3 | 2 | 3 | 3 |
| | | | | | 2 | SB6 | | | | | | | |
| | | | | | 3 | S31-36 | C36 | 0 | 4 | 3 | 2 | 1 | 5 |

CHART 2

| Change Key Number | Sub-master Key Number |
|---|---|
| C1 | S1-6 |
| C2 | S1-6 |
| C3 | S1-6 |
| C4 | S1-6 |
| C5 | S1-6 |
| C6 | S1-6 |
| C7 | S7-12 |
| C8 | S7-12 |
| C9 | S7-12 |
| C10 | S7-12 |
| C11 | S7-12 |
| C12 | S7-12 |
| C13 | S13-18 |
| C14 | S13-18 |
| C15 | S13-18 |
| C16 | S13-18 |
| C17 | S13-18 |

CHART 2-continued

| Change Key Number | Sub-master Key Number |
|---|---|
| C18 | S13-18 |
| C19 | S19-24 |
| C20 | S19-24 |
| C21 | S19-24 |
| C22 | S19-24 |
| C23 | S19-24 |
| C24 | S19-24 |
| C25 | S25-30 |
| C26 | S25-30 |
| C27 | S25-30 |
| C28 | S25-30 |
| C29 | S25-30 |
| C30 | S25-30 |
| C31 | S31-36 |
| C32 | S31-36 |
| C33 | S31-36 |
| C34 | S31-36 |
| C35 | S31-36 |
| C36 | S31-36 |

* * * * *